US009157685B2

(12) United States Patent
Dixon et al.

(10) Patent No.: US 9,157,685 B2
(45) Date of Patent: Oct. 13, 2015

(54) HEAT EXCHANGER MAINTENANCE TECHNIQUE

(76) Inventors: Christopher J. Dixon, Corpus Christi, TX (US); Ronald G. Reeves, Corpus Christi, TX (US); Ryan E. Parker, Corpus Christi, TX (US)

( * ) Notice: Subject to any disclaimer, the term of this patent is extended or adjusted under 35 U.S.C. 154(b) by 592 days.

(21) Appl. No.: 13/066,283

(22) Filed: Apr. 11, 2011

(65) Prior Publication Data

US 2011/0247786 A1 Oct. 13, 2011

Related U.S. Application Data

(60) Provisional application No. 61/322,851, filed on Apr. 10, 2010, provisional application No. 61/351,877, filed on Jun. 5, 2010.

(51) Int. Cl.

| | |
|---|---|
| ***F28G 1/12*** | (2006.01) |
| ***F28F 27/00*** | (2006.01) |
| ***F28F 1/10*** | (2006.01) |
| ***F28D 7/16*** | (2006.01) |
| ***F28F 9/007*** | (2006.01) |
| ***F28F 11/02*** | (2006.01) |
| ***F28G 1/02*** | (2006.01) |
| ***F28G 3/04*** | (2006.01) |
| ***F28G 9/00*** | (2006.01) |
| ***F28G 15/08*** | (2006.01) |

(52) U.S. Cl.

CPC . *F28D 7/16* (2013.01); *F28F 9/007* (2013.01); *F28F 11/02* (2013.01); *F28G 1/02* (2013.01); *F28G 3/04* (2013.01); *F28G 9/00* (2013.01); *F28G 15/08* (2013.01); *Y10T 29/4935* (2015.01)

(58) Field of Classification Search

CPC ..... F28D 7/16; F28G 3/04; F28G 1/02; F28G 15/08; F28G 9/00; F28F 6/007; F28F 11/02; Y10T 29/4935

USPC ..... 165/95, 96, 172, 173, 303; 29/890.03, 29/890.031; 15/104.16, 104.2

See application file for complete search history.

(56) References Cited

U.S. PATENT DOCUMENTS

| | | | | |
|---|---|---|---|---|
| 571,016 A | | 10/1896 | Pratt | |
| 1,807,457 A | * | 5/1931 | Weis | 165/95 |
| 2,069,574 A | * | 2/1937 | Bowers | 165/95 |
| 2,634,164 A | | 4/1953 | Drake | |
| 2,882,022 A | * | 4/1959 | Greathouse et al. | 165/95 |
| 3,312,274 A | | 4/1967 | Sebald | |

(Continued)

FOREIGN PATENT DOCUMENTS

| | | |
|---|---|---|
| WO | WO 87/05992 | 10/1987 |
| WO | WO 90/09556 | 8/1990 |
| WO | WO 2010/095110 | 8/2010 |

*Primary Examiner* — Brandon M. Rosati
*Assistant Examiner* — Claire Rojohn, III
(74) *Attorney, Agent, or Firm* — G. Turner Moller, Jr.

(57) ABSTRACT

A heat exchanger is cleaned, inspected and/or plugged while the heat exchanger is in operation. In some embodiments, the heat exchanger includes a channel cover having valve-seal assemblies allowing isolation tools to be inserted through the channel cover into sealing engagement with the ends of tubes to provide a flow path separate from the normal flow paths through the heat exchanger. Cleaning and/or inspecting can be done through the isolation tools and tubes that are leaking can be plugged through the valve-seal assemblies. In some embodiments, brushes are located inside the heat exchanger and can be independently advanced into cleaning relation with a large majority of the tubes.

15 Claims, 20 Drawing Sheets

(56) References Cited

U.S. PATENT DOCUMENTS

| | | | | | |
|---|---|---|---|---|---|
| 3,384,161 | A | * | 5/1968 | Malmstrom et al. | 165/94 |
| 3,708,098 | A | | 1/1973 | Roznovsky | |
| 3,954,136 | A | | 5/1976 | Gugel | |
| 4,054,060 | A | | 10/1977 | Ueno | |
| 4,174,750 | A | * | 11/1979 | Nichols | 165/94 |
| 4,269,264 | A | * | 5/1981 | Goeldner | 165/95 |
| 4,357,991 | A | * | 11/1982 | Cameron | 165/159 |
| 4,452,183 | A | | 6/1984 | Yazidjian | |
| 4,545,426 | A | * | 10/1985 | Collins | 165/95 |
| 4,562,886 | A | * | 1/1986 | Holm | 165/94 |
| 4,599,975 | A | | 7/1986 | Reeve | |
| 4,778,005 | A | * | 10/1988 | Smith | 165/160 |
| 4,844,021 | A | | 7/1989 | Stoss | |
| 4,920,994 | A | | 5/1990 | Nachbar | |
| 5,060,600 | A | | 10/1991 | Brown | |
| 5,083,606 | A | | 1/1992 | Brown | |
| 5,307,866 | A | | 5/1994 | Weigel | |
| 5,311,929 | A | * | 5/1994 | Verret | 165/95 |
| 5,499,639 | A | * | 3/1996 | Williams, Jr. | 134/7 |
| 5,512,140 | A | | 4/1996 | Rutan | |
| 5,518,067 | A | * | 5/1996 | Finch et al. | 165/92 |
| 5,537,832 | A | * | 7/1996 | Keus | 62/544 |
| 5,846,301 | A | * | 12/1998 | Johnson et al. | 96/52 |
| 5,979,543 | A | * | 11/1999 | Graham | 165/134.1 |
| 5,983,994 | A | * | 11/1999 | Tsou | 165/94 |
| 6,408,936 | B2 | * | 6/2002 | Duran | 165/94 |
| 6,609,531 | B2 | * | 8/2003 | Lesko | 134/169 C |
| 6,827,091 | B2 | * | 12/2004 | Harrison | 134/22.18 |
| 6,945,316 | B2 | * | 9/2005 | Schildmann et al. | 165/95 |
| 7,410,611 | B2 | * | 8/2008 | Salbilla | 422/22 |
| 8,485,139 | B2 | * | 7/2013 | Kim et al. | 122/379 |
| 2005/0067148 | A1 | * | 3/2005 | Grobelny et al. | 165/95 |
| 2006/0144562 | A1 | * | 7/2006 | Castello | 165/84 |
| 2008/0000620 | A1 | * | 1/2008 | Tao | 165/95 |

* cited by examiner

Fig. 13
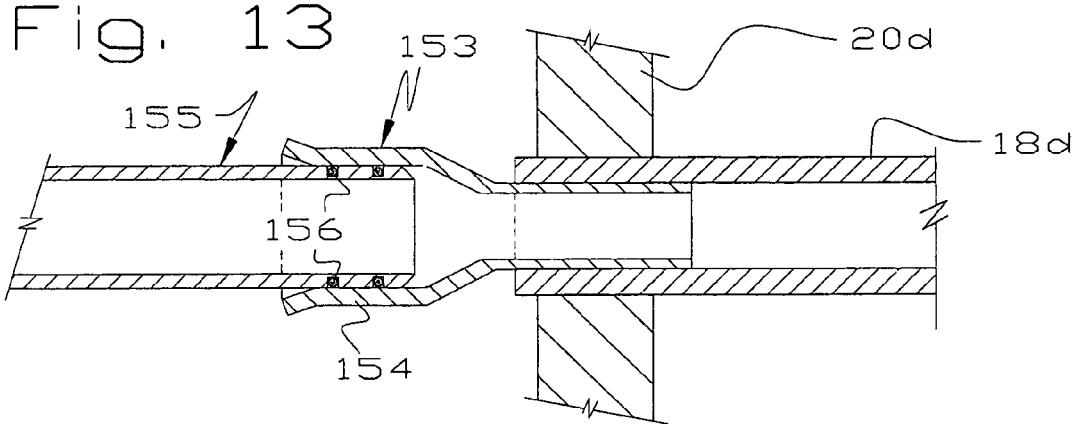
Fig. 14
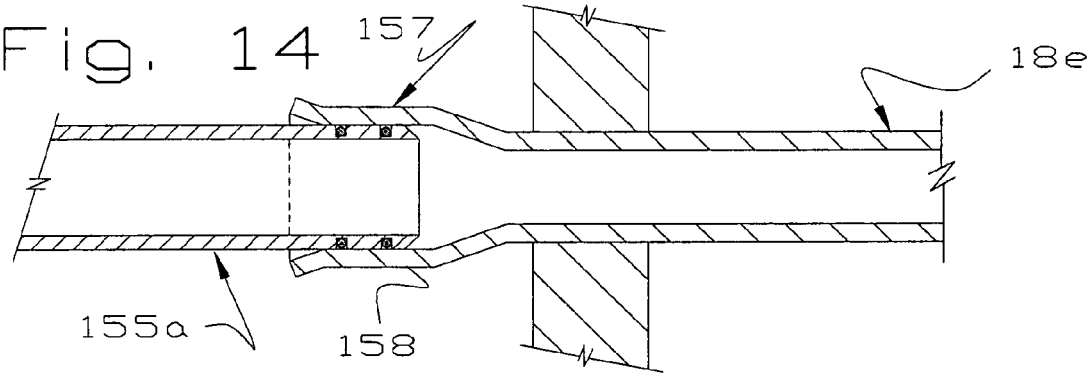
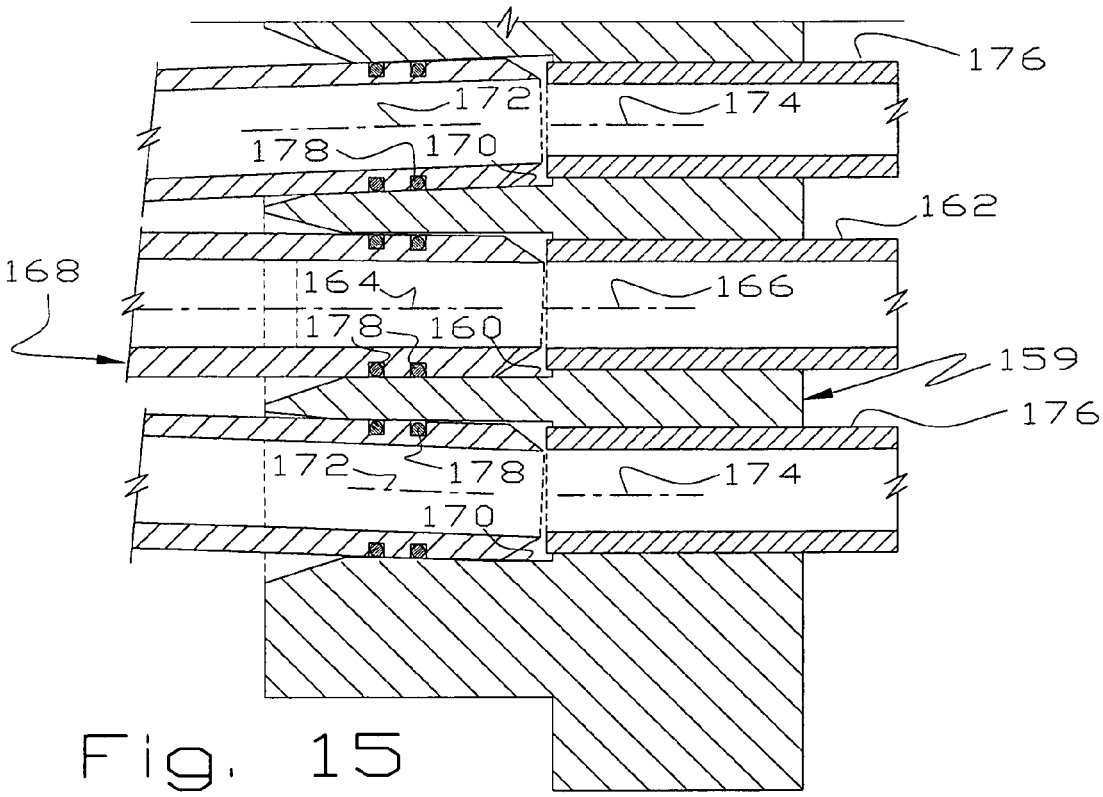
Fig. 15

HEAT EXCHANGER MAINTENANCE TECHNIQUE

This application is based on Provisional Applications Ser. No. 61/322,851, filed Apr. 10, 2010 and Ser. No. 61/351,877 filed Jun. 5, 2010, priority of which is hereby claimed, the disclosures of which are incorporated herein by reference.

This invention relates to a method and apparatus for inspecting, testing, cleaning and/or plugging tubes of a heat exchanger while the heat exchanger is in operation.

BACKGROUND OF THE INVENTION

There are several types of heat exchangers used in various industries. A common type is known as a shell and tube type. Modern shell and tube exchangers are of several types, including: (1) a straight through version where the heat exchange tubes are generally straight, (2) a U-tube version where the heat exchange tubes are bent into a U so the inlets and outlets of the heat exchange tubes pass through the same tube sheet and open into compartments provided by a channel and (3) a floating head type where the inlets and outlets are at one end of the exchanger, the tubes are straight and open, at the opposite end of the exchanger, into a floating head or manifold that directs flow back toward the outlet. U-tube type heat exchangers have a cost advantage because only one set of inlet/outlet channels is required. Straight through heat exchangers are typically selected when the tube side fluid deposits materials in the tube or is corrosive because it is usually more difficult to clean the curve in a U-tube type.

The performance of shell and tube heat exchangers degrades over time by the deposition of solids from the tube side flow onto the inside wall of the heat exchanger tubes. This is commonly referred to as tube side fouling and can significantly impair the performance of heat exchangers. Fouling deposits act as an insulator and thereby reduce heat transfer across the walls of the tubes. This fouling can also cause increased pressure drops across the tubes thereby decreasing flow through the tubes. Under certain conditions, these deposits can also promote corrosion of the inside of the tube wall, a phenomenon known as under-deposit corrosion. This corrosion, if left unchecked, can produce leak paths through the tube wall allowing commingling of the heat exchange fluid and the process fluid. Even though tube side fouling is a persistent maintenance problem, it is much preferred to shell side fouling because it is much easier to clean and inspect the interior of the heat exchange tubes as compared to the outside. For this reason, in situations where one of the two fluids is more corrosive or more prone to produce deposits in the heat exchanger, this fluid may preferably be put through the tubes rather than through the shell.

Various methods have been developed to clean the inside of heat exchanger tubes to remove deposits. These deposits are often relatively hard and therefore difficult to remove from the tube walls. To effectively clean tube side fouling, the heat exchanger must be taken off-line and out of service to access and mechanically clean the inside of the tubes. These off-line methods of cleaning include high pressure water cleaning known as hydroblasting, mechanical cleaning using brushes, scrapers or projectiles, and blasting with abrasive media. Once the tubes are cleaned and while the heat exchanger is off-line, the tubes may be inspected to determine if corrosion has thinned or pitted the tube wall and a determination can be made to replace or retain the tube. In some circumstances, the tube may be replaced or simply plugged, i.e. a plug is placed in the tube to block flow through it.

As currently practiced, all inspection techniques require the heat exchanger to be out of service. Cleaning by circulation of abrasive media may conventionally be done while a heat exchanger is in operation by inserting media into the flow entering the tubes and then separating the media from flow out of the tubes. As currently practiced, heat exchangers must be out of service in order to plug a leaking or unserviceable tube. The cost of disassembling and then reassembling the heat exchanger to permit access to the tubes for cleaning and inspection can be significant. More significant in many situations is the lost production cost from taking the heat exchanger and its associated equipment out of service.

The costs associated with reduced capacity of heat exchanger tubes can also be substantial in situations where the throughput of process fluids has to be curtailed. In one oil refinery, the estimated lost production costs of reduced throughput from a catalytic cracker due to deteriorating heat exchange performance has been in the range of $500,000/year.

Disclosures relative to this invention are found in U.S. Pat. Nos. 571,016; 2,882,022; 3,312,274; 3,708,098; 3,954,136; 4,599,975; 4,920,994; 5,060,600; 5,083,606; 5,307,866; 5,512,140; 5,983,994 and 6,408,936 and in WIPO publications WO 87/05992, WO 90/09556 and WO 2010/095110.

SUMMARY OF THE INVENTION

The overall goal of the disclosed method and apparatus is to clean, inspect, test and/or plug heat exchanger tubes while the heat exchanger is in operation. Modern heat exchangers include a densely packed array of tubes opening into a pair of compartments where the tubes provide a first flow path and a second flow path is provided on the outside of the tubes. In the case of a shell and tube heat exchanger, the shell provides a second flow path. In the case of an air fin heat exchanger, the outside of the tubes are open to the atmosphere and a fan is provided to force air across the outside of the tubes. A characteristic of modern heat exchangers is that the tubes are very close together as explained more fully hereinafter.

In one aspect of the disclosed method and apparatus, an independent isolated flow path is established through a selected tube by passing conduits through the compartments and seating the conduits in fluid tight relation with the tube inlet and outlet. The isolated flow path may be emptied, purged or reduced in pressure thereby allowing cleaning, testing, inspecting and/or plugging the tube without contending with pressurized fluid in the tube. The system used to accomplish these goals can reach at least 80% of the tubes in a heat exchanger. Several different embodiments and accessories are disclosed to accomplish these functions in either newly constructed heat exchangers or in existing heat exchangers modified for this purpose.

In another aspect of the disclosed method and apparatus, a series of brushes are mounted inside the compartment into which the tubes open. The brush shafts extend through seals in the compartment wall. When it is desired to clean the tubes, the brushes are advanced singly into selected ones of the tubes and may preferably be rotated by a drive motor outside the heat exchanger. Several different embodiments or accessories are disclosed to accomplish these functions.

It is an object of this invention to provide an improved method and apparatus for cleaning, testing, inspecting and/or plugging heat exchanger tubes while the heat exchanger is in operation.

A more specific object of this invention is to provide an improved method and apparatus for cleaning heat exchanger tubes while the heat exchanger is in operation utilizing brushes which may be incorporated into the heat exchanger.

A further object of this invention is to provide a heat exchanger having a compartment wall designed to accommodate the leak free insertion of tube isolation tools and or other maintenance equipment during operation of the heat exchanger at high capacity.

These and other objects and advantages of this invention will become more apparent as this description proceeds, reference being made to the accompanying drawings and appended claims.

BRIEF DESCRIPTION OF THE DRAWINGS

FIGS. 9-15 are enlarged cross-sectional views of several different embodiments of isolation tube ends and the mating ends of the heat exchange tubes;

DETAILED DESCRIPTION OF THE INVENTION

Although there are a variety of embodiments disclosed which involve cleaning, inspecting, testing and/or plugging of heat exchanger tubes while the exchanger is in operation, it is understood that these embodiments are merely suggestive of numerous other approaches or techniques which may be adopted for these purposes. In general, descriptive statements do not delimit the claims in this application and some statements relative to one embodiment or feature are not necessarily applicable to other embodiments or features.

Tubular heat exchangers come in many forms and have many names. Some of the more common industrial heat exchangers that can be cleaned, inspected, tested and/or plugged with the devices disclosed herein include shell and tube heat exchangers, boilers, surface condensers and air cooled fin tube exchangers. In one sense, the disclosed devices operate on the inside of the tubes and what occurs on the outside of the tubes may be of any description. The devices disclosed may be used in many industries and many applications including oil refiners, petrochemical plants, chemical or pharmaceutical plants, coal and gas fired power plants, nuclear power plants, pulp and paper plants, mining and smelting operations, food and consumer product manufacturing, commercial heating and cooling, and military installations and equipment.

Figure 1:
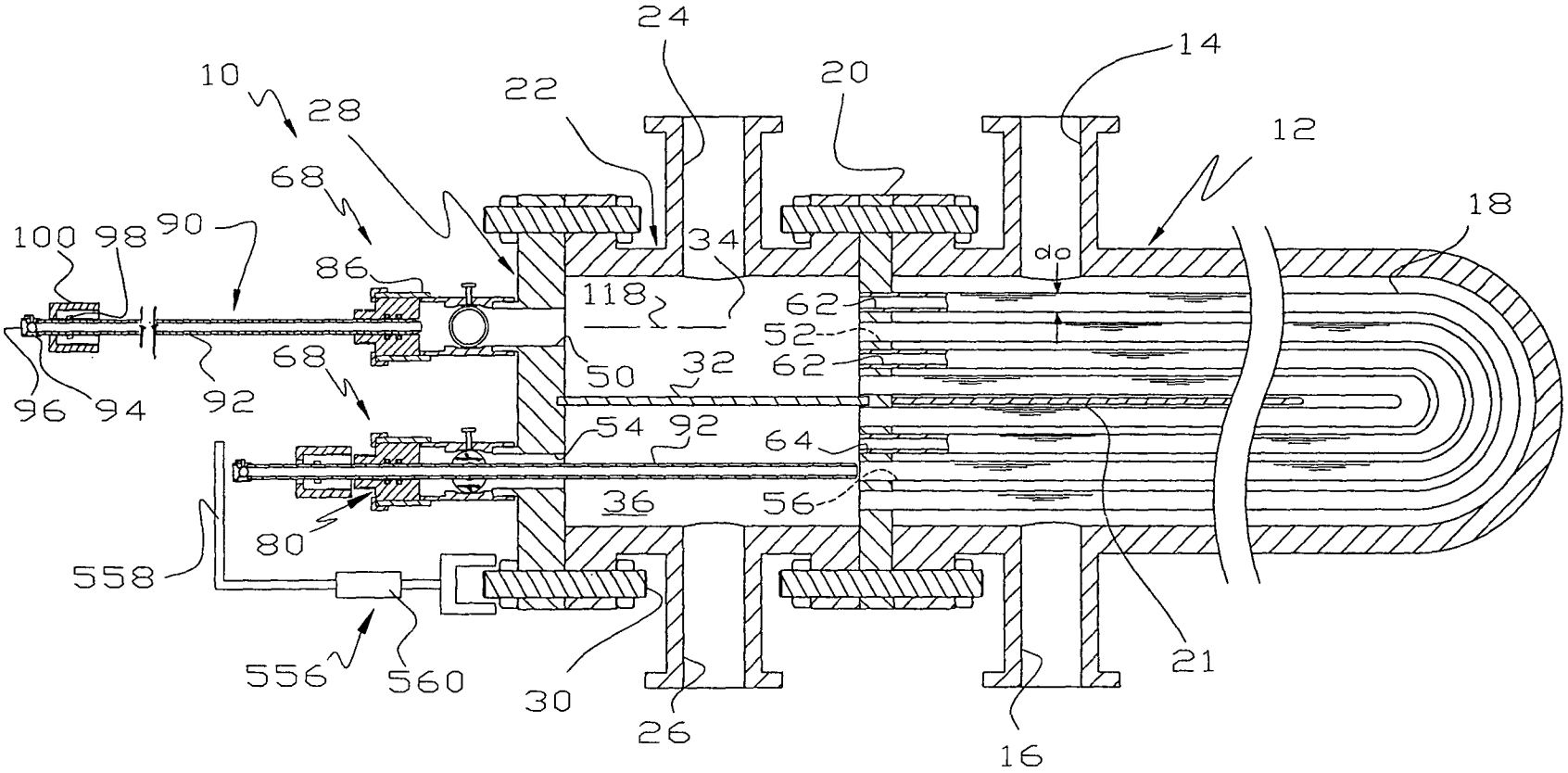
FIG. 1 is a cross-sectional view of a heat exchanger illustrating one embodiment of a system to maintain the heat exchanger while it is operation.
Figure 2:
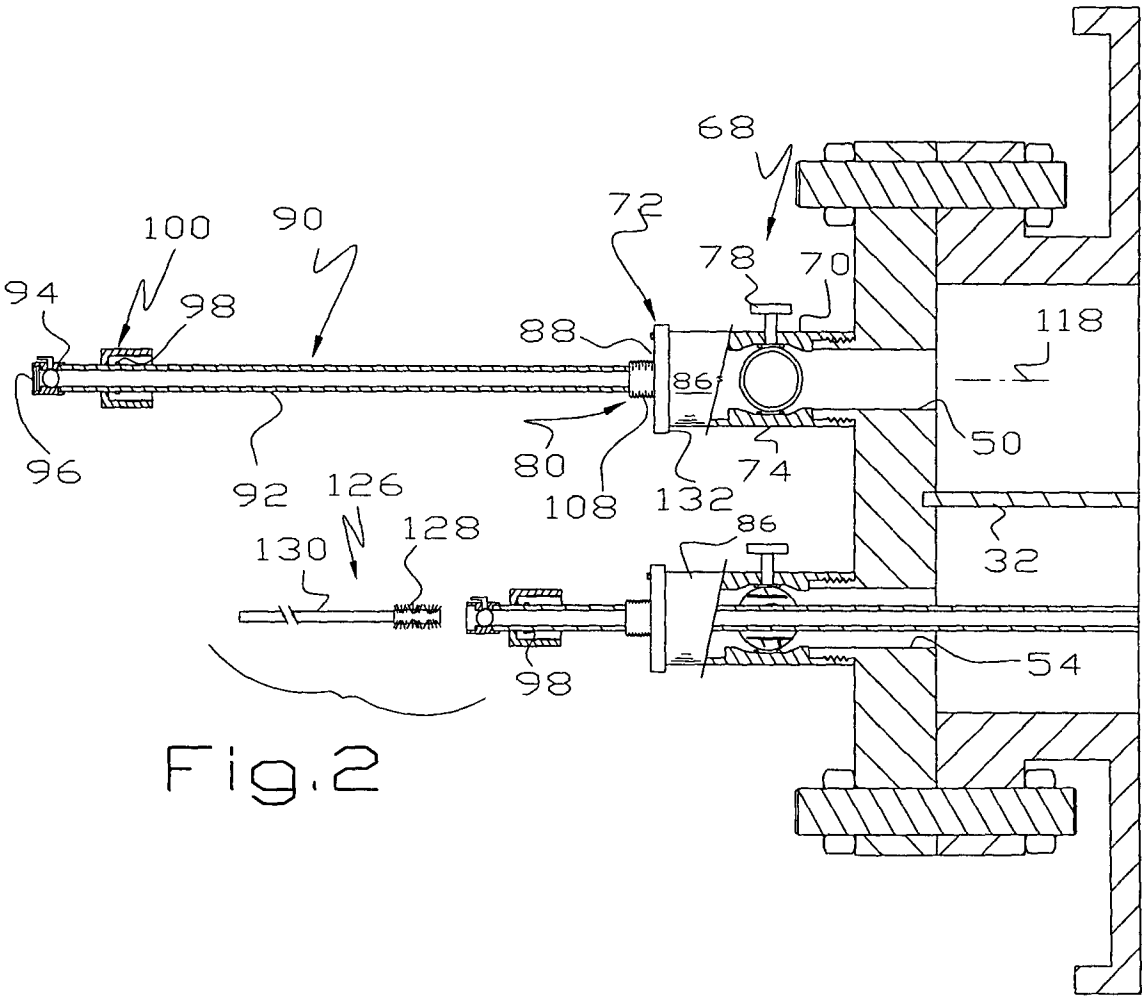
FIG. 2 is an enlarged view of part of FIG. 1.

Referring to FIGS. 1-2, a heat exchanger 10 can be of the shell and tube type including a shell 12 having an inlet 14 and outlet 16 for shell side flow. An array of U-shaped tubes 18 are inside the shell 12 and are attached at both ends to a tube sheet 20. A partition wall 21 directs flow in the shell around the U-tubes 18. A manifold or channel 22 can be removably attached to the shell 12 and includes an inlet 24 and an outlet 26 for tube side flow. A channel cover, blind flange or dollar plate 28 can be removably attached to the channel 22 by a series of nut and bolt assemblies 30. A partition plate 32 can divide the manifold 22 into an inlet chamber 34 in which the inlet ends of the tubes 18 open and an outlet chamber 36 into which the outlet ends of the tubes 18 open. Tube side flow enters through the inlet 24, passes through the inlet chamber 34 and enters the inlet ends of the tubes 18. After tube side flow exits from the tubes 18 into the outlet chamber 36, it passes through the outlet 26. Shell side flow passes through the shell inlet 14, around the outside of the tubes 18 and out through the outlet 16. It will be seen that the heat exchanger 10 provides independent flow paths for process flow and heat exchange fluid flow. Because of a temperature differential across the tubes 18, the hotter of the flow streams gives up heat to the cooler of the streams in a conventional manner. Those skilled in the art will recognize the heat exchanger 10, as heretofore described, as being typical of a modern heat exchanger.

Although the heat exchanger 10 is illustrated as being a shell and tube heat exchanger of the U-tube type, it will be apparent that the disclosed method and apparatus are useable in other types of heat exchangers as mentioned above, including a shell and type heat exchanger having straight tubes exiting through a pair of opposite tube sheets and accessible through a pair of removable channel covers and other heat exchangers as discussed previously.

Figure 3:
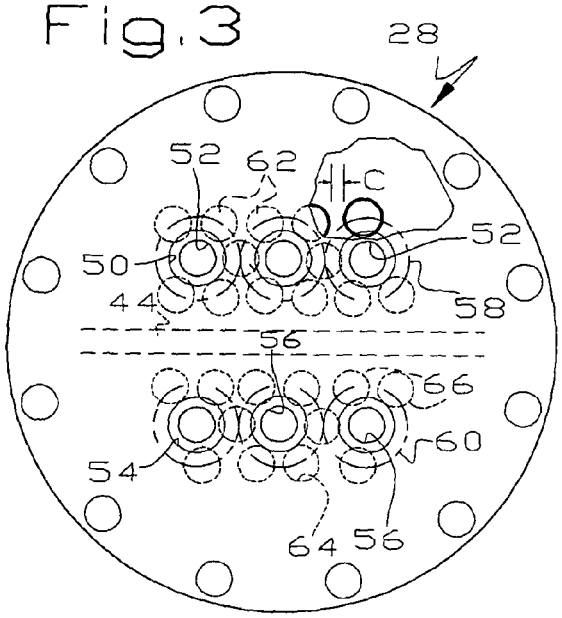
FIG. 3 is an end view of the channel cover of FIGS. 1-2, certain parts being removed for clarity of illustration.

One characteristic of practical modern heat exchangers is there is a rather small variation in tube diameter and a rather small variation in spacing between tubes. Smaller tubes have greater heat exchange surface but produce larger pressure drops in tube side flow while larger tubes have the opposite characteristics. Larger spacing between the tubes produces smaller pressure drops in shell side flow but sometimes awkward flow distribution and thus less efficient heat exchange. This combination of effects tends to produce practical heat exchangers with a small variation in tube O.D.'s and a small variation in spacing between tubes. In the industry, this combination is known as tube pitch where:

$$P_t = d_o + c$$

where $P_t$ is tube pitch, $d_o$ is tube outside diameter and C is clearance or horizontal spacing between the O.D. of horizontal tubes as shown in FIG. 3. Tubes are typically in a square pattern with a tube at each corner of a square or in a triangular pattern with a tube at each angle of an isosceles triangle although there are an infinite number of possible patterns. Typical tube pitch values are shown in Table I:

TABLE I

| Tube O.D., inches | Square Pitch, inches | Triangular Pitch, inches |
|---|---|---|
| 5/8 | 7/8 | 25/32 |
| 3/4 | 1 | 15/16 or 1 |
| 1 | 1 1/4 | 1 1/4 |
| 1/4 | 1 9/16 | 1 9/16 |
| 1/2 | 1 7/8 | 1 7/8 |

These values are taken from a publication of P & I Design Ltd., Teesside, U.K. and is available at: www.chemstations.com/content/documents/Technical_Articles/shell.PDF. In these tube O.D.'s, it will be seen that clearance C varies from 1/4" to 3/8" in square pitch heat exchangers while clearance C varies from 5/32" to 3/8" in triangular pitch heat exchangers. Of interest, a majority of industrial heat exchangers have 3/4" O.D. tubes followed by heat exchangers having 1" O.D. tubes with other sizes amounting to a small percentage of heat exchangers. If one were to construct a ratio of $C/d_o$, it would vary between 0.25-0.4 for square pitch heat exchangers and would be between about 0.20-0.25 for triangular heat exchangers. As will become apparent, the method and apparatus disclosed herein can be particularly useful with heat exchangers having closely spaced tubes, i.e. a ratio of $C/d_o$ in the range of about 0.2-0.5 and ideally with heat exchangers having a ratio of $C/d_o$ of 0.2-0.4.

In order to clean, inspect or repair heat exchanger tubes in many industrial applications, it is not sufficient to isolate one or a few heat exchanger tubes because, running at more-or-less maximum capacity for months or years on end, many different tubes in a heat exchanger suffer from one problem or other and not all experience the same problem. In many industrial applications, one cannot shut down a heat exchanger without shutting down a considerable part of a plant, such an oil refinery or chemical plant. In these situations, heat exchanger maintenance is done during turnarounds where all or a substantial part of the plant or refinery is shut down and all sorts of maintenance or repair work is done on an expedited around the clock basis. If a heat exchanger in such an industrial plant begins to function inefficiently or a leak develops in a tube, there is little that can be done other than reduce process flow through the production unit to maintain the desired heat exchange outlet temperatures or minimize leakage.

Heat exchangers are intentionally over designed in the sense that the exchanger will deliver its required performance when less than all of the tubes are functioning at predicted levels. For example, heat exchangers are often designed to function at their desired capacity when only 90% of the heat exchanger tubes are performing normally. This leaves some room for reduced performance due to loss of heat transfer efficiency across the tube walls, for loss of flow capacity through the tubes and/or plugging of leaking tubes. Thus, if one has the capability of servicing a high percentage of tubes in a heat exchanger while it is operating, one has the capability of keeping a heat exchanger operating at capacity until the next turnaround when the heat exchanger can be more thoroughly repaired or replaced. Being able to prolong high capacity in a heat exchanger can have substantial economic effects. In heat exchangers operated in conjunction with a crude unit in an oil refinery, the cost of heating process fluids can rise as much as 25% between turnarounds as the efficiency of the heat exchangers declines.

The difficulty in servicing most, or all, of the tubes of a heat exchanger is space and geometry. Heat exchangers have many tubes spaced very close together as is apparent from the discussion about tube pitch. Consideration of Table I shows the distance between adjacent tubes in the stated size range is between 1/4-3/8", meaning that adjacent tubes have a clear area around the O.D. of 1/8-3/16" greater than the O.D. of the tube. In other words, in the configuration of FIG. 3 where the valves are attached to align with every other tube in a row of tubes, whatever is attached to the channel cover 28 can have an operative O.D. of no more than twice the O.D. of the tube 18. It is particularly difficult because it may be desirable to have the I.D. of the isolation tool not much smaller than the I.D. of the tube 18. It is thus difficult to provide mechanisms on the outside of the channel cover that will allow equipment to be passed through the channel cover and align with or pass through all or most of the heat exchanger tubes.

A goal of the method and apparatus disclosed is to have the capability of servicing at least 80% of the tubes of a heat exchanger. It may be preferred to have the capability of servicing at least 90% of the tubes of a heat exchanger and, ideally, it may be preferred to have the capability of servicing all of the tubes of a heat exchanger.

To this end, one approach can be to provide one access opening for a series of adjacent heat exchanger tubes. One version of this concept is shown in FIG. 3 where the channel cover 28 provides a series of passages 50 in a row aligned with a like number of tube inlet ends 52 and a series of passages 54 align with a like number of tube outlet ends 56. As is apparent from FIGS. 1-3, the passages 50, 54 are larger than the I.D. of the tube ends 52, 56. The through passages 50, 54 are in the centers of imaginary circles 58, 60 which pass through a series or family of inlet and outlet ends 62, 64 which are non-coaxially aligned with the passages 50, 54. Thus, one approach to servicing 80% or more of the tubes of a heat exchanger is to provide a valve-seal assembly on each of the through passages 50, 54 so equipment can be passed into the aligned tube end 52, 56 and into the tubes ends intersected by the imaginary circles 58, 60 surrounding each through passage 50, 54. The common patterns for heat exchanger tubes are square and triangular pitch but there are an infinite number of possibilities. For every tube pattern, there is a complementary pattern for the passages 50, 54 and the mechanism used to reach the adjacent non-aligned tube ends 62, 64. Thus, one approach for reaching 80% or more of the tube ends is to provide a mechanism for inserting an isolation tool directly into an aligned tube end 52, 56 and providing an indexing arrangement for altering the angle of approach of the isolation tool to a family of adjacent tube ends 62, 64.

Referring to FIGS. 1-2, a valve-seal assembly or mechanical seal 68 can be provided for each of the through passages 50, 54 and is designed to allow probes or isolation tools to be inserted into the pressurized heat exchanger 10 without leaking or allowing the escape of process fluid or any appreciable amount of heat exchange fluid. The assemblies 68 may be as simple or as complex as desired, including multiple valves and/or multiple seals. Heat exchangers operate at a wide range of pressures depending on the pressure of the fluids being circulated through the exchanger. Process fluids tend to be at higher pressures while coolants, typically water, normally are at relatively modest pressures. At some low pressure, there is no need to seal against the isolation tools but this pressure is much lower than found in practical heat exchangers where even coolant pressure is in the range of 20-100 psig. If coolant at these pressures were allowed to escape through one of the openings 50, 54 reduction in coolant flow through the tubes 18 might create a serious problem because process flow in the shell would exit the heat exchanger at much higher temperatures than designed. In addition, there are manifest safety and personnel problems trying to work on a heat exchanger spewing hot coolant.

To reduce or control leakage, the valve-seal assemblies 68 can include a valve 70 and a seal assembly 72. The valve 70 can include a valve body 74 attached to the channel cover 28 in any suitable manner such as by threading onto an external boss 76. The seal assembly 72 can include a bushing or guide block 80 having a passage 82 therethrough equipped with seals 84 such as O-rings or the like. In the alternative, the O-rings may be on the outside of the isolation tool and seal against a smooth passage on the inside of the guide block 80. The guide block 80 can be attached to the valve body 74 in any suitable manner or may be located in a housing attached to the valve body 74 in any suitable manner for purposes more fully apparent hereinafter. The passage 82 of the guide block 80 is designed to pass a probe or isolation tool 90 therethrough to mate with the aligned tube end 52, 56 i.e. the passage 82 may be in the center of the guide block 80 having an axis coincident with the axis of the tube end 52, 56.

The isolation tool 90 can include a conduit 92 having a valve 94 near the end having a fitting 96 for connection to a hose to discharge the contents of a selected one of the tubes 18 as will be explained more fully hereinafter. The conduit 92 can be round to easily seal against the seals 84 providing leak free or relatively leak free insertion of the isolation tool 90 into the heat exchanger 10. Preferably, the conduit 92 can be forced into mating engagement with the tube end 62, 64. To this end, the tool 90 can include a stop 98 fixed to the conduit 92 and a coupling 100 slidable on the conduit 92. Threads on the inside of the coupling 100 engage threads on the guide block 80 so threading the coupling 100 on the guide block 80 causes the coupling 100 to engage the stop 98 and force the conduit 92 to the right in FIGS. 1-2 to force a tapered end 102 of the conduit 92 into sealing engagement with the tube 18.

A comparison of the upper and lower parts of FIG. 1 shows insertion of the isolation tool 90 into mating engagement with the inlet and outlet ends of a selected tube 18 thereby establishing a flow path through a selected one of the heat exchanger tubes that is independent of the tube side and shell side flow paths. The valves 94 on the isolation tools 92 allow the selected tube 18 to be depressured or opened to the atmosphere if the tube side flow is water or other similar coolant and purged with air to empty the selected tube. If tube side flow is process fluid, the selected tube can be connected through the isolation tools 90 to a plant decommissioning system where process fluids are routinely handled and purged with nitrogen. In either event, the selected tube is deinventoried and its pressure is reduced which can be atmospheric to make working conditions easier. This allows cleaning, inspecting, testing and/or plugging of the selected tube without having to contend with pressurized contents of the heat exchanger and, if a flammable or toxic process fluid is in the tubes 18, without contending with a potentially hot flammable volatile or toxic fluid.

Figure 4:
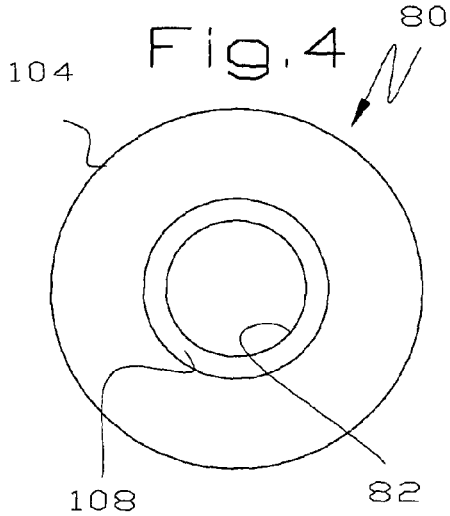
FIG. 4 is an end view of a block used to guide an isolation tool into a coaxially aligned heat exchanger tube.

FIG. 4 is an end view of the block 80 used to guide the isolation tool 90 into an aligned tube end. The guide block 80 can accordingly include a body 104 having the centered passage 82 therethrough and a centered threaded end 108 to which the coupling attaches. Because the centered passage 82 aligns with one of the tube ends 52, 56, the isolation tool 90 can be passed linearly through the guide block 80 into sealing engagement with the selected tube end 52, 56. Cleaning, testing and/or inspecting tools can be run through the conduit 92 of the isolation tools to first clean and or inspect the aligned tube 18. When maintenance operations are complete, the tools can be removed from the heat exchanger 10 and the valve 70 closed.

Figure 6:
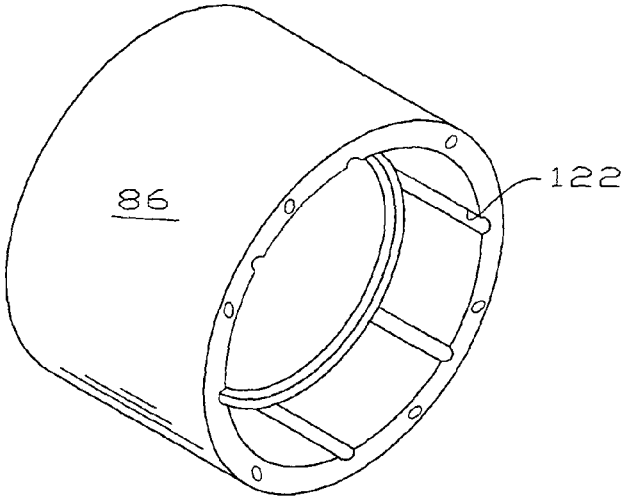
FIG. 6 is an end view of a guide block housing.
Figure 5:
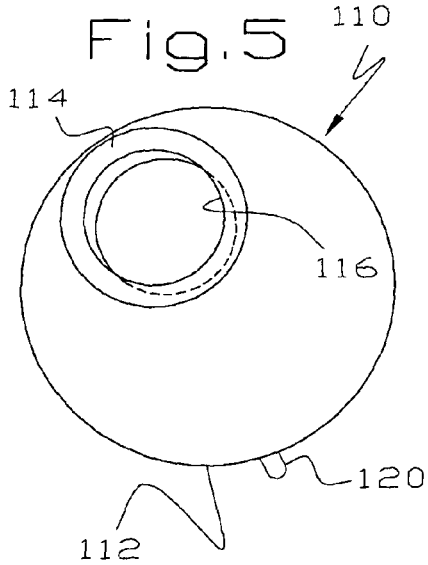
FIG. 5 is an end view of a block used to guide an isolation tool into a non-coaxially aligned heat exchange tube.
Figure 7:
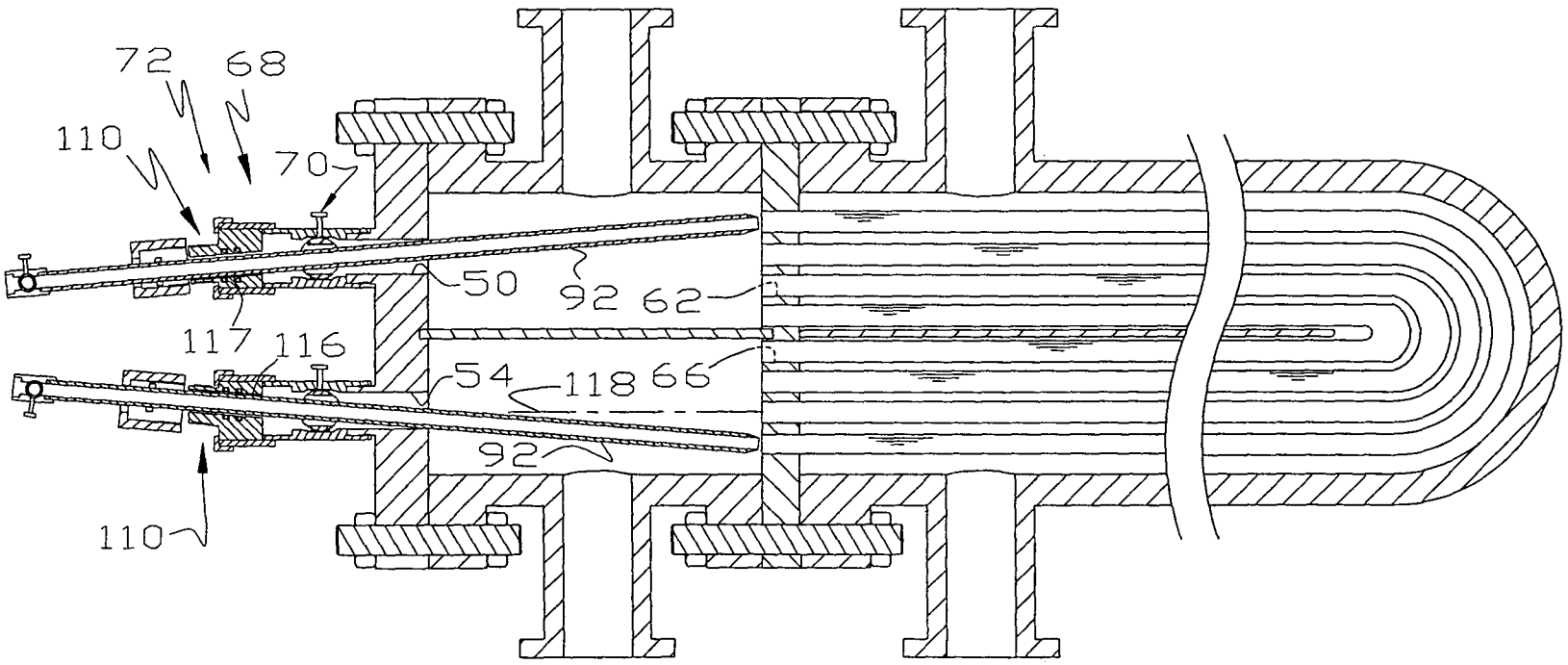
FIG. 7 is a view similar to FIGS. 1-2 illustrating the isolation of a non-coaxially aligned tube.

Referring to FIGS. 5-7, there is disclosed one technique for maintaining the non-aligned tubes 18 corresponding to the tube ends 46, 48 shown in FIG. 3. To this end, the guide block 80 of FIG. 4 is removed from the valve-seal assembly 68 by removing the fasteners 88 and an end cap 132 thereby providing access to the interior of the housing 86. The guide block 80 can be replaced by a guide block 110 to guide the isolation tools 90 into the non-aligned tube ends 62, 64 suggested in FIG. 3. The guide block 110 can include a body 112 having an off-center threaded end 114 and a passage 116 at a slight angle to an axis 118 aimed at the aligned tube end. The off-centered threaded end 114 is parallel to the passage 116 so the collar 100 can thread onto the end 114 and advance the isolation tool 90 into sealing engagement with the non-aligned tube ends. One or more seals 117 on the inside of the passage 116 (FIG. 7) seal against the outside of the conduit 92. The guide block 110 includes a ball detent 120 on the exterior of the body 112 received in one of a series of notches or slots 122 opening through an end of the housing 86. This can position the block 110 at the angle necessary for the isolation tool 90 to reach each of the non-aligned tube ends 62, 64 shown in FIG. 3. Cleaning, testing and/or inspecting tools can be run through the conduit 92 of the isolation tools to conduct maintenance operations on the non-aligned tubes surrounding the aligned tube. When maintenance operations are complete, the tools can be removed from the heat exchanger 10 and the valve 70 closed.

Conducting maintenance operations on an aligned tube and then on the family of non-aligned tubes surrounding or partly surrounding the aligned tube is typically repeated as desired as more fully discussed hereinafter. It will accordingly be seen that a very large percentage of the tubes 18 of the heat exchanger 10 can be isolated, depressured, deinventoried, cleaned and/or inspected. Thus, it is possible to conduct considerable maintenance on a heat exchanger while it is operating at high capacity and thereby keep it in operation until the next turnaround or regularly scheduled off-line maintenance opportunity.

One cleaning tool may be a simple brush 126 comprising bristles 128 on the end of a shaft 130 as shown in FIG. 1. After the selected tube 18 is depressured, the brush 126 can be run through the valve-seal assembly 68 to clean the inside of the selected tube. Although the brush 126 need not be sealed relative to the assembly 68, a further seal assembly (not shown) may be provided to attach to the fitting 96 and seal against the exterior of the shaft 130. The brush 126 may be reciprocated and/or rotated with a suitable power source such as an electric or air powered motor. Similarly, a hollow high pressure water cleaning lance can be inserted through the conduit 92, either without sealing or through a seal assembly (not shown) attached to the fitting 96.

It will be seen that the arrangement of FIG. 3 illustrates a situation where isolation tools 90 inserted through a central passage 50, 52 reach an aligned tube and an array of non-aligned tubes 62, 64 that reside in a circle around the passages 50, 52. In another embodiment, this concept can be taken further by providing another guide block having a more inclined passage that allows an isolation tool extending through it to reach a second array of non-aligned tubes surrounding the first array 62, 64. In the event the angle between the isolation tool and the non-aligned tubes surrounding the first array is too large, an insert or flanged conduit can be used to position the channel cover 28 further from the tube sheet 20.

It will be apparent there are seals between the conduit 92 and the guide blocks 80, 110, between the guide blocks 80, 110 and their housings 86 and any others as necessary to control pressure inside the heat exchanger 10 and thereby prevent or minimize leakage of the heat exchange fluid or the process fluid to atmosphere in or around the isolation tools 90.

Another maintenance operation that can be conducted in an inspection of the tubes 18 with a device to measure the thickness of the wall of the tubes. These are typically eddy current devices and are commercially available. For eddy current devices to work optimally, the O.D. of the eddy current device should be on the order of at least 80% of the I.D. of the tube being inspected. Thus, the I.D. of isolation tool 90 through which the eddy current device may be run may ideally be the same as the I.D. of the tubes 18.

It will be apparent that the tubes 18 may be pressure tested during a maintenance operation by passing a test tool (not shown) through isolation tools into opposite ends of the selected tube 18. A mechanically, pneumatically or hydraulically expandable plug on each test tool is expanded to seal off the selected tube. A suitable pressure or a suitable vacuum can be applied to the selected tube 18 between the test tool seals. Another simple way to determine if a selected tube 18 is leaking is to watch for any fluid escaping through the conduit 92 during cleaning. If the fluid is from tube side flow, there is an inadequate seal with the tube ends 52, 56. If the fluid is from shell side flow, the selected tube is leaking.

Figure 8:
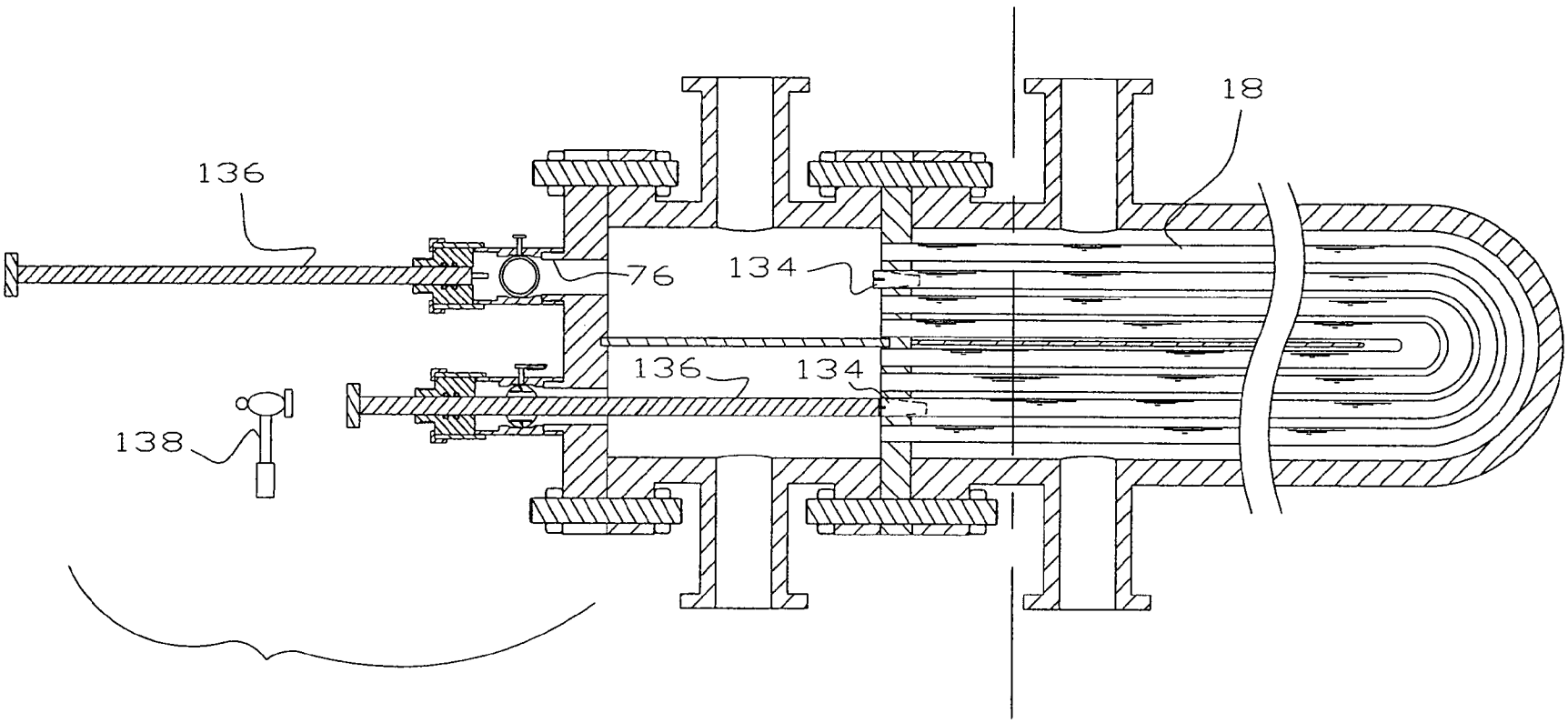
FIG. 8 is a view similar to FIGS. 1-2 illustrating one approach to plug a tube.

It may occur that conducting maintenance on one of the tubes 18 reveals that it is leaking thereby allowing the commingling of process and heat exchange fluids. In these situations, it may be decided to plug the unserviceable tube. Referring to FIG. 8, there is illustrated one technique for plugging a selected tube 18. A tapered plug 134 is threaded onto the end of a setting tool 136 which is run through the valve-seal assemblies 68 so the plug 134 enters the end of an aligned or non-aligned selected tube 18. The end of the setting tool 136 is struck sharply, as with a hammer 138 thereby driving the tapered plug 134 into one end of the selected tube. The setting tool 136 is then unthreaded from the plug 134 and removed from the heat exchanger 10. It may be preferred to plug both ends of the selected tube, as suggested in FIG. 8, to prevent commingling of process and heat exchange fluids. There are several alternative techniques for plugging a selected tube, including running an expandable plug (not shown) through one of the isolation tools 90, seating the expandable plug in the selected tube, expanding the plug and then removing the isolation tool.

When the on-line maintenance of the heat exchanger 10 is complete, the isolation tools 90 and any other equipment are removed from the heat exchanger 10. A variety of approaches may be used to plug the openings 50, 52 through which the isolation tools are run. The valves 70 may be left in place. A plug 194 may be run through the valve 70 and seated in the passage 50 and the valve 70 then removed. Other approaches may be apparent to those skilled in the art.

Figure 9:
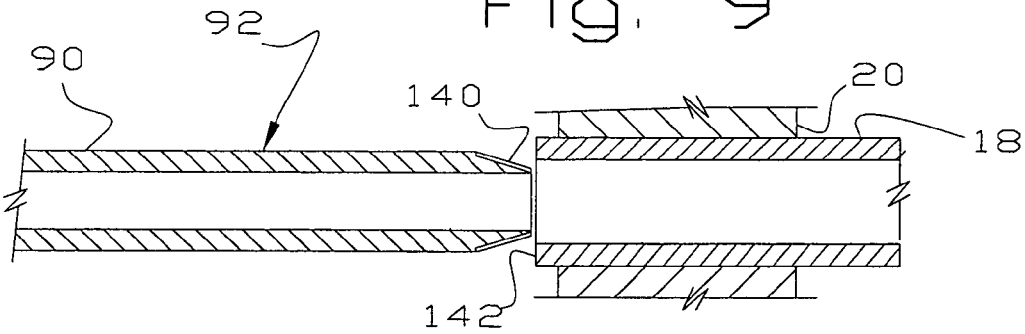

Referring to FIGS. 9-15, there are illustrated a series of embodiments showing different designs for the connection between the isolation tools and the tubes 18. In FIG. 9, the isolation tool 90 includes a tapered forward end having a resilient layer 140 to seat against a blunt end 142 of the tube which extends out of the tube sheet 20. One advantage of this arrangement is the I.D. of the conduit 92 may be close to the I.D. of the tube 18. Specifically, the conduit I.D. may be about 75% of the tube I.D.

Figure 10:
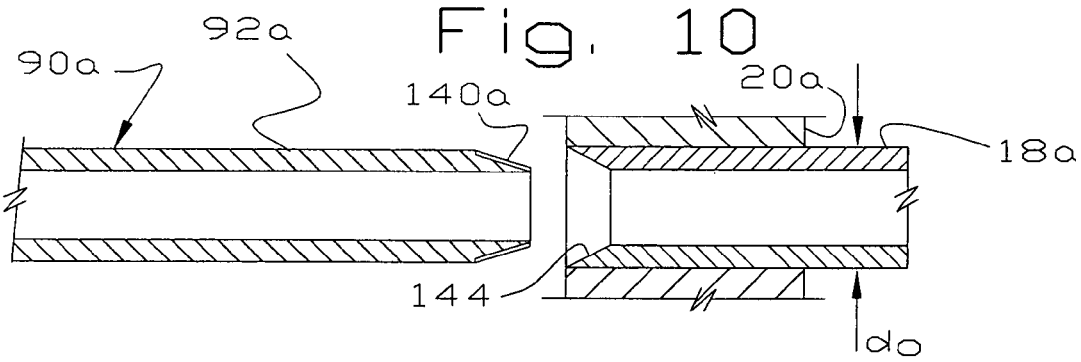

In FIG. 10, the junction between the tube 18*a* and the tube sheet 20*a* provides a chamfered or beveled end 144 where the end of the bevel 144 is at the edge of the tube sheet 20*a*. This allows the tapered conduit end or resilient layer 140*a* to seat in such a manner that the I.D. of the conduit 92*a* can be 95% of the I.D. of the tube 18*a*. It will be seen that machining of the tube 18 or tube sheet 20 is necessary and may be done during manufacture or, in the case of a retrofitted heat exchanger, during a turnaround.

Figure 11:
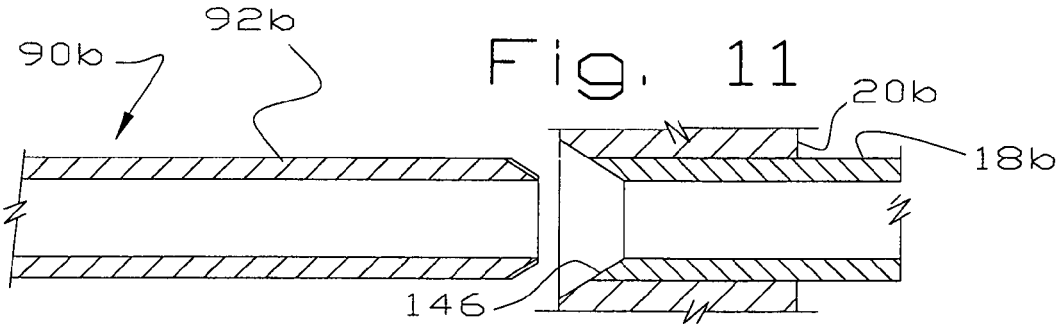

In FIG. 11, the junction between the tube 18*b* and the tube sheet 20*b* provides a chamfered or bevelled end 146 where the end of the bevel is inside the boundaries of the tube sheet 20*b*. This allows the I.D. of the conduit 92*b* to be the same as the I.D. of the tube 20*b*. This is advantageous because eddy current testers which measure the thickness of the wall of the heat exchanger tubes operate best if the O.D. of the eddy current tester is only slightly less than the I.D. of the wall thickness being measured. To provide the beveled end 146, the tube end can be machined during manufacturing of a new heat exchanger or during a turnaround when the heat exchanger 10 is out of service.

Figure 12:
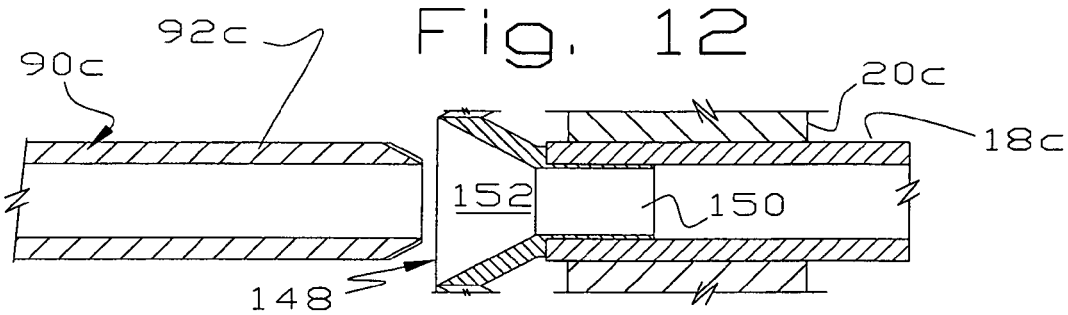
Figure 16:
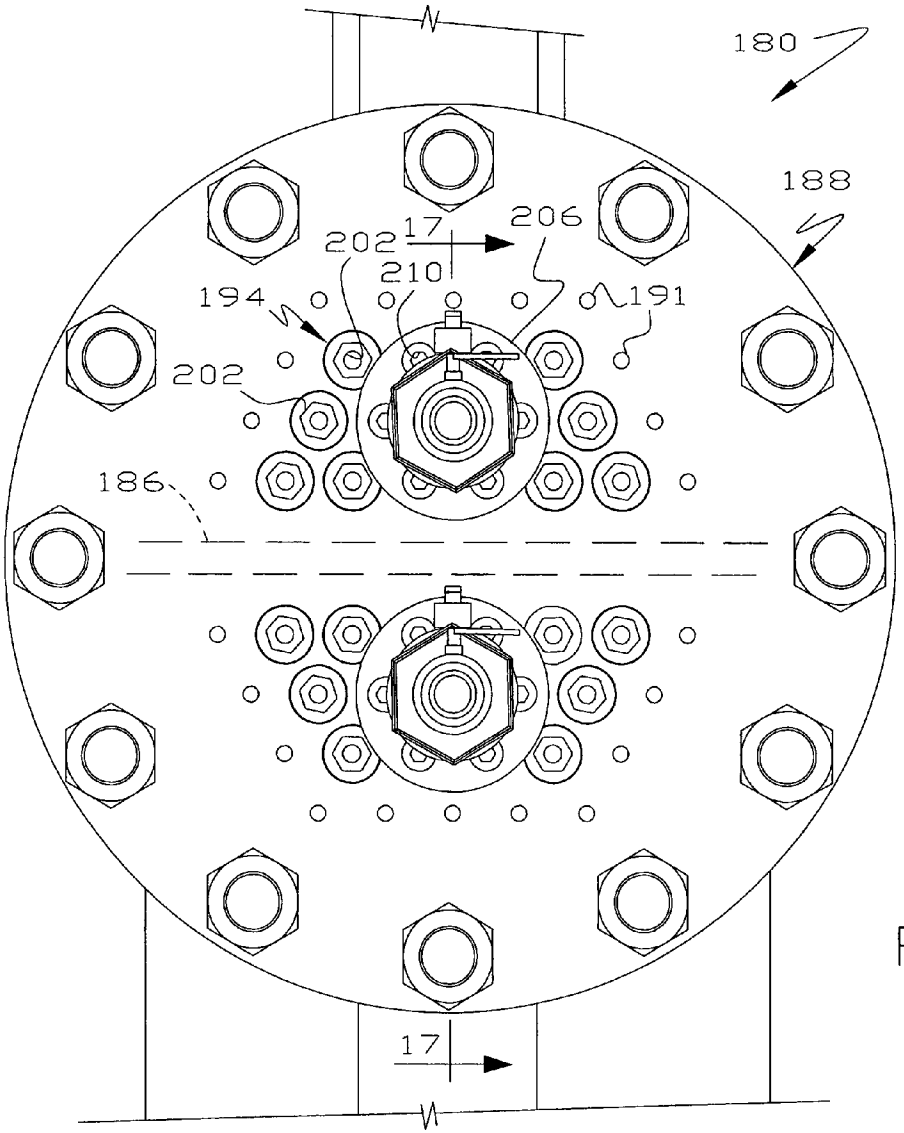
FIG. 16 is an end view of another embodiment of a system to maintain an on-line heat exchanger, certain parts being omitted for purposes of illustration.

In FIG. 12, the junction between the tube 18*c* and the tube sheet 20*c* includes an insert 148 having a tubular section 150 press fit or otherwise secured in the tube 18*c* and a funnel section 152 outside the tube sheet 20*c*. This arrangement makes it much easier for the isolation tool 90*c* to mate with the desired tube 18*c*. The insert 148 may be installed during manufacture of a new heat exchanger or during a turnaround when the heat exchanger 10 is out of service.

In FIG. 13, the junction between the tube 18*d* and the tube sheet 20*d* includes an insert 153 press fit or otherwise secured in the tube 18*d* having an elongate straight section 154. This allows an insertion tool 155 having seals 156 to seal against the straight section 154. The insert 153 may be installed during manufacture of a new heat exchanger or during a turnaround when the heat exchange 10 is out of service.

In FIG. 14, the junction between the tube 18*e* and the tube sheet 20*e* incorporates an upset end 157 of the tube 18*e* having an elongate straight section 158 allowing the isolation tool 155*a* to seal against the straight section 158.

In FIG. 15, a tube sheet 159 is manufactured to provide a series of passages 160 which are aligned with the tubes 162, meaning that the axis 164 of the passage 160 is coincident with the axis 166 of the tube 162. The passages 160 and tubes 162 are coaxial with the through passages 50 shown in FIG. 3 so an isolation tool or lance 168 can be advanced along the axis 164 into engagement with the passage 160. The tube sheet 159 also includes a series of passages 170 corresponding to the tube ends 62, 64 arranged around a central passage as suggested in FIG. 3. The passages 170 provide an axis 172 at a slight angle to the axis 174 of the non-aligned tubes 176. This angle corresponds to the angle provided by the inclined passage 116 in the guide block 110.

The arrangement of FIG. 15 provides several advantages. One or more O-ring seals 178 can be provided adjacent an end of the isolation tool 168 to seal against the passages 160, 170. The inclination of the passages 170 allows the isolation tool 168 to fit snugly without binding and without the need for a seating force to be applied to the isolation lance 168. This arrangement allows the I.D. of the isolation tool 168 can be the same as the I.D. of the tubes 162, 176.

It will be seen that the junctions of FIGS. 10-15 allow the I.D. of the isolation tools to be the same, or larger, than the I.D. of the heat exchange tubes. This is of great advantage, particularly when sending eddy current measuring tools or other equipment into the heat exchange tubes where the tools require, or work best, at close tolerances to the I.D. of the heat exchanger tube.

Another approach for maintaining 80% or more of the tubes of a heat exchanger is shown in FIGS. 16-19 where a heat exchanger 180 includes an inlet compartment 182 and an outlet compartment 184 bounded by a tube sheet (not shown), a partition wall 186 and a removable channel cover 188. A series of tubes (not shown) open into the compartments 182, 184 and the channel cover 188 provides a through passage 190 providing an axis 192 aligned with each of the tubes and a series of blind threaded openings 191 on the outside of the through passages 190 for purposes more fully apparent hereinafter. The passages 190 are sealed, during normal heat exchanger operation, with a plug 194 held in place in any suitable manner as by providing mating threads or other mechanical connections between the passages 190 and the plug 194.

Figure 17:
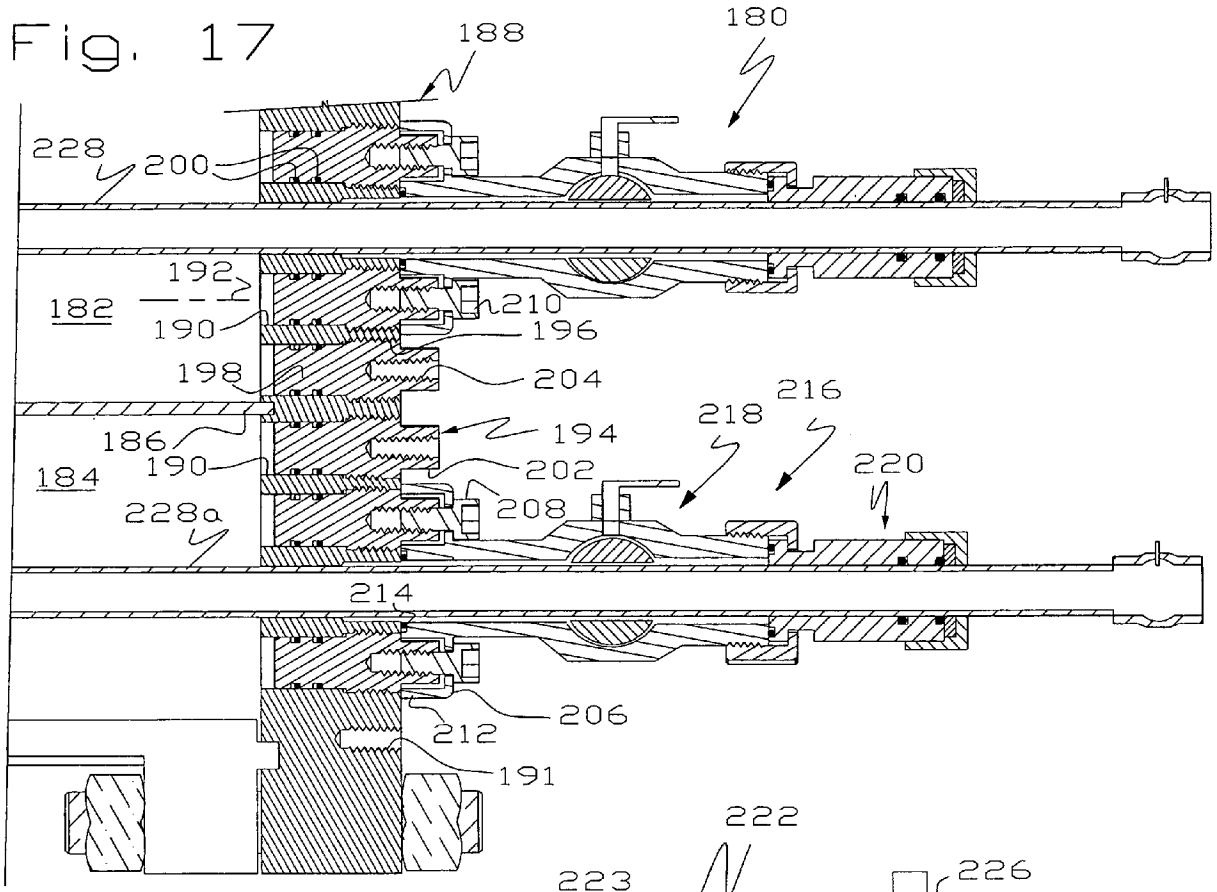
FIG. 17 is a cross-sectional view of the embodiment of FIG. 16, taken substantially along line 17-17 thereof, as viewed in the direction indicated by the arrows.
Figure 19:
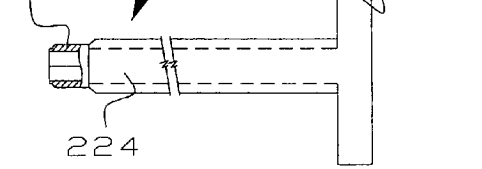
FIG. 19 is a side view of a plug removal tool used with the device of FIGS. 16-18.
Figure 18:
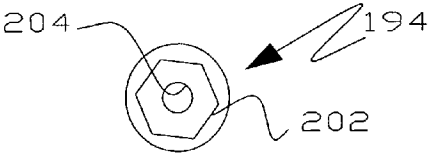
FIG. 18 is an end view of one of the plugs in the embodiment of FIGS. 16-17.

Although the passages 190 could be sealed with a simple threaded plug, FIG. 17 illustrates the passages 190 as sealed with a plug 194 having an end 196 providing external threads mating with threads in the channel cover 188 and a seal end 198 providing one or more assemblies 200 sealing against the passage 190. The seals 200 prevent corrosion of threads joining the plugs 194 and channel cover 188 and may be preferred in some environments. The plugs 194 can also include a polygonal boss 202 providing a blind threaded passage 204 as shown best in FIG. 18. If desired, a bolt (not shown) may be threaded into the passages 191, 204 to avoid corrosion of their threads. These modifications to the channel cover 188 have no effect on normal operation of the heat exchanger 180.

When it is desired to conduct maintenance operations on the heat exchanger 180, a valve 218 having a flange 206 can be attached to the plugs 194 surrounding the passage 190 aligned with the tube to be worked on. This can be accomplished by threading bolts 208 into the blind passages 204 of the plugs 194 in a circle around the selected passage 190 as shown best in FIG. 17. The bolts 208 can include a polygonal socket 210 to receive a driver because there is normally not sufficient room for a wrench to work on the outside of the bolts 208. The flange 206 includes a face 212 abutting a planar section of the channel cover 188 so a seal 214 prevents the escape of heat exchanger fluid from the passage 190 that is to be entered.

A valve-seal assembly 216 includes the valve 218 and a seal assembly 220 for sealing against the outside of an isolation tool and is thus analogous to the valve-seal assembly 68 of FIGS. 1 and 2. A plug removal tool 222 can be provided to remove the plug 194. The plug removal tool 222 can include a mating connector, such as a socket 223, on one end of a rod 224 sealed by the seal assembly 220 and a handle 226. The plug removal tool 222 is run through the valve-seal assembly 216 and coupled to the polygonal nut 202 to unthread and remove the plug 194 without producing leakage of heat exchanger fluids.

One of the valve-seal assemblies 216 is attached to the channel cover 188 on each side of the partition wall 186 through openings 190 aligned with the inlet and outlet ends of a selected heat exchanger tube. An isolation tool 228 can then be passed through one of the assemblies 216 to seat against the inlet end of the selected tube and an isolation tool **228*a* can then be passed through the other valve-seal assembly to seat against the outlet end of the selected tube to isolate one of the heat exchanger tubes from tube side flow. Suitable maintenance operations can then be conducted through the isolation tools 228 in the same manner as in the embodiment of FIGS. 1-8. At the end of the maintenance operations, the isolation tools 228 can be withdrawn from the heat exchange 180 and a new or reconditioned plug 194 can be inserted into the passages 190 thereby returning the heat exchanger 180 to normal operation. The valve-seal assemblies 216 can be removed from the channel cover 188. The embodiment of FIGS. 16-19 has the advantage of requiring no permanently attached valve-seal assemblies 216 on the channel cover 188** but is somewhat slower to conduct maintenance operations on a large number of tubes.

After the maintenance operations are finished on the initial selected passage 190 and its plug 194 replaced, the valve-seal assembly 216 is removed and attached to another set of plugs 194 to enter another selected passage 190. When this is repeated enough, the outside edge of the flange 206 no longer overlaps one of the plugs 194 but instead overlies one of the blind threaded openings 191. When this occurs, the blind opening 191 is used as an anchor for one of the fasteners 208 and thereby allow removal of a plug 194 adjacent the outer periphery of the array of heat exchanger tubes.

Figure 20:
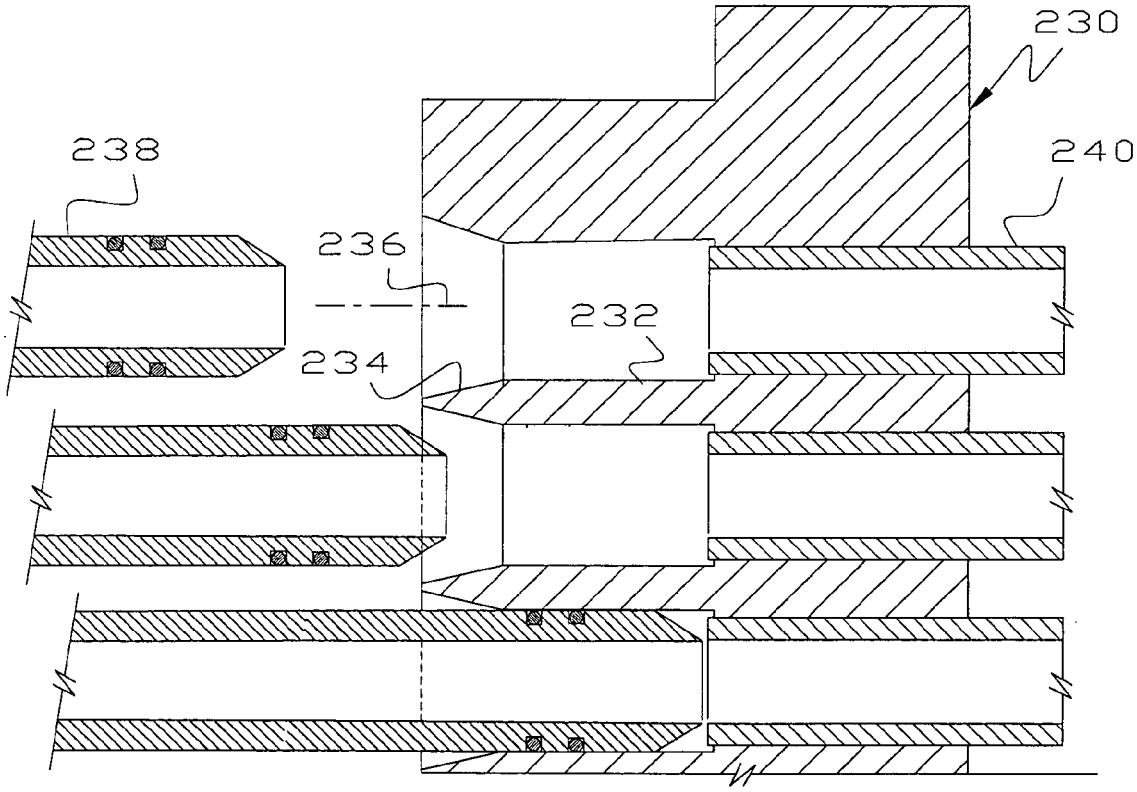
FIG. 20 is a cross-sectional view of a tube sheet showing a junction between an isolation tool and the tube sheet.

Referring to FIG. 20, there is illustrated a tube sheet 230 analogous to the tube sheet 159 of FIG. 15 having a series of passages 232 providing an enlarged mouth 234 and axes 236 aligned with the axes 192 of the channel cover 188 of FIG. 17. An important advantage of the tube sheet 230 is the I.D. of the isolation conduits or lances 238 can be equal to or larger than the I.D. of the heat exchanger tubes 240 and that no seating force needs to be applied to the lance 238 to achieve a seal.

Figure 21:
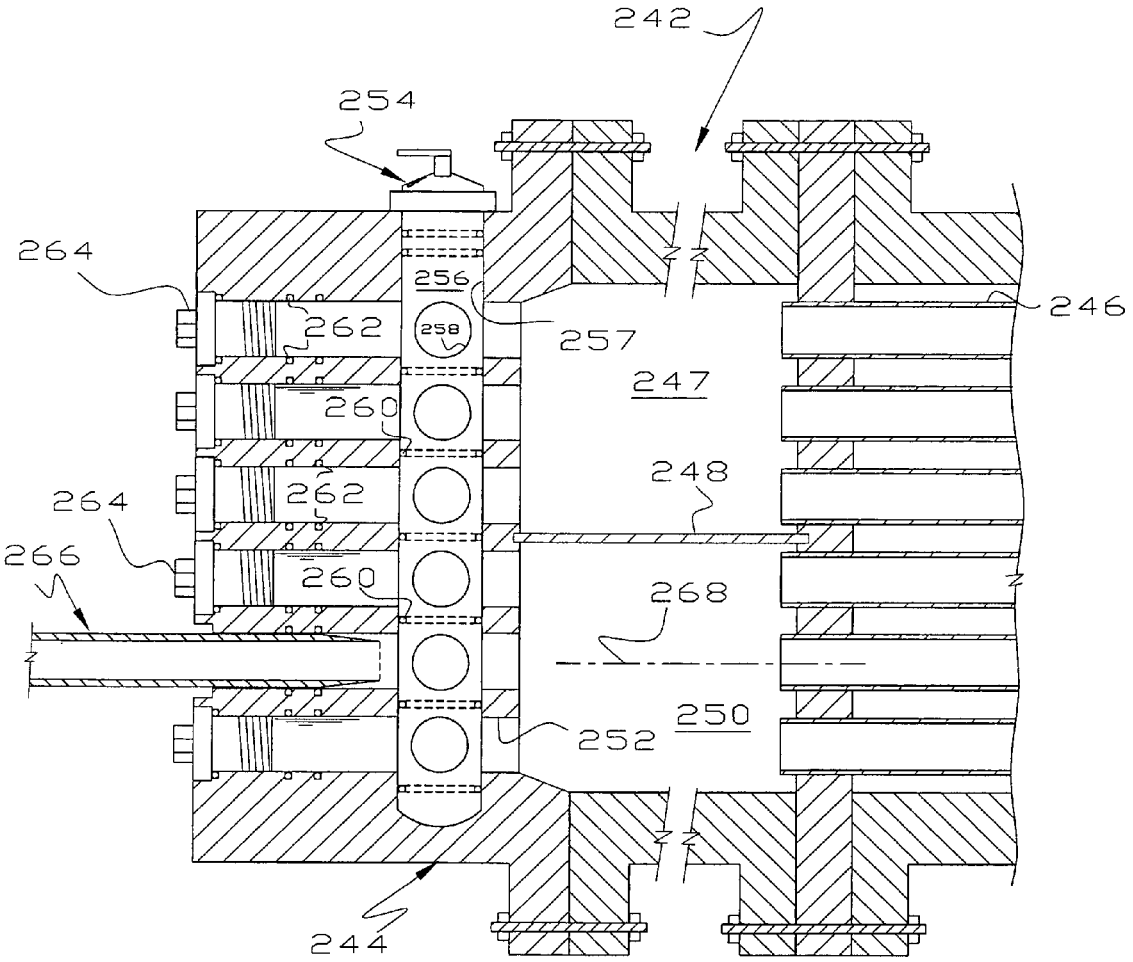
FIG. 21 is a cross-sectional view of another embodiment of a system to maintain an on-line heat exchanger.

Referring to FIG. 21, there is illustrated another approach for inserting isolation tools into a heat exchanger 242 through a channel cover 244 in order to do maintenance operations on a very large percent, or all, of the tubes 246. A partition wall 248 divides the channel into an inlet compartment 247 and an outlet compartment 250. The channel cover 244 includes a series of passages 252 aligned with the tubes 246. A vertically positioned valve 254 includes a cylindrical valve body 256 mounted for rotation in a passage 257 intersecting a group of the passages 252. The valve body 256 can provide a passage 258 for each of the passages 252 intersected by the passage 257. Suitable seals 260 prevent fluids from adjacent passages 252 from mixing. A seal assembly 262 and a closure 264 is provided for each of the passages 252. The closure 264 can be a simple bolt providing a polygonal head for receiving a wrench or socket and sealed with an o-ring or gasket. The valve 254 is normally closed to block flow through the passages 252 although it will be seen that it may be open. In the case of a straight through type heat exchanger, a similar channel cover is provided at the opposite end of the heat exchanger. It will be apparent that a valve 254 can be provided for each vertical row of passages 252 through the channel cover 244. The valves 254 may be staggered in the thickness dimension of the channel cover 244 to provide adequate clearance.

When it is desired to conduct a maintenance operation on a selected one of the tubes 246, the valve 254 is closed and the closure 264 aligned with the selected tube 246 is removed. An isolation tool 266 is inserted into the open passage 252 until the seals 262 seat around the outside of the tool 266. The valve 254 is then opened which allows the tool 266 to be passed through the valve 254 along the axis 268 into sealing engagement with the selected tube 246. The same operation is conducted on the other end of the tube 246 to isolate it from tube side flow. A cleaning implement, wall thickness measuring device or other maintenance tool is run through the isolation tools 266 to perform the desired maintenance. The isolation tools 266 are then removed from the heat exchanger 242 in reverse order to place the selected tube back into service. This is repeated with successive ones of the tubes 246 until a desired number of the tubes are cleaned and/or inspected.

One of the peculiarities of the embodiment of FIG. 21 is the valve 254 may be oriented in such a way as to take advantage of the standard tube arrangement where the inlet and outlet ends of the tubes 246 are in the same plane. Thus, a pair of isolation tools 266 are inserted through vertically disposed seal assemblies 262 which align with the selected ends of the selected tube 246. The valve 254 is opened allowing both tools 266 to be inserted through different passages 252 in the same valve 254 into sealing engagement with the inlet and outlet ends of the same tube.

Figure 22:
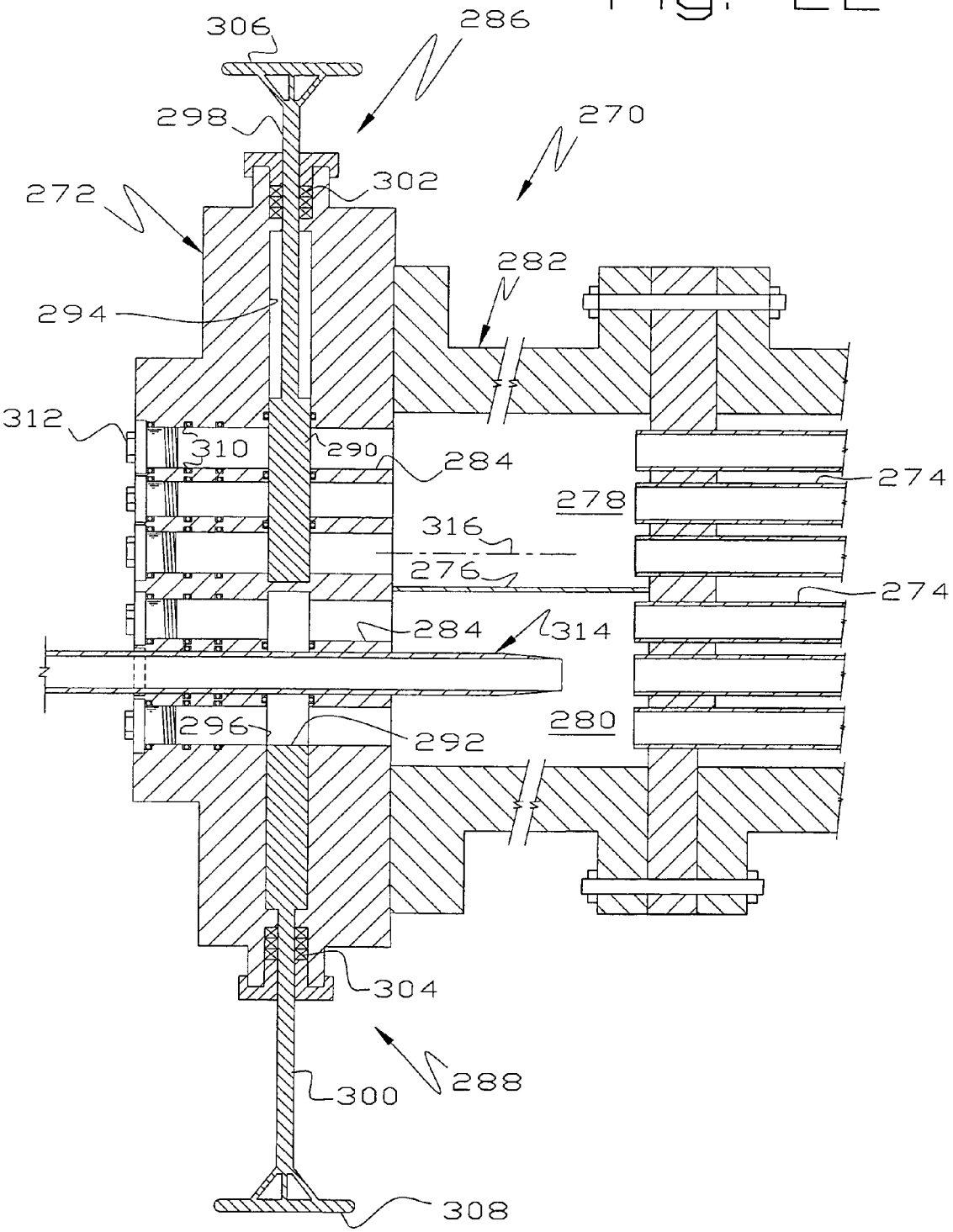
FIG. 22 is a cross-sectional view of another embodiment of a system, similar to FIG. 21, to maintain an on-line heat exchanger.

Referring to FIG. 22, there is illustrated another approach for inserting isolation tools into a heat exchanger 270 through a channel cover 272 in order to do maintenance operations on a very large percent, or all, of the tubes 274. A partition wall 276 provides an inlet compartment 278 and an outlet compartment 280 in a channel or manifold 282. The channel cover 272 includes a series of passages 284 aligned with the tubes 274. A pair of gate valves 286, 288 each includes a gate body 290, 292 mounted for linear movement in a passage 294, 296 intersecting a group of the passages 284. Suitable seals (not shown) can be provided to seal between the gate bodies 290, 292 and the channel cover 272. The gate bodies 290, 292 may be advanced and/or retracted by any suitable mechanism such as a valve stem 298, 300 sealed by suitable seals 302, 304 and valve wheels 306, 308. The gate valves 286, 288 may be operated by pushing or pulling on the valve wheels 306, 308 or a suitable mechanism may be provide to convert rotary movement of the wheels 306, 308 into reciprocating movement of the valve bodies 290, 292.

A seal assembly 310 and a closure 312 is provided for each of the passages 284. The closure 312 can be a simple plug providing a polygonal head for receiving a wrench or socket and sealed by an o-ring or gasket. The valves 286, 288, which may be aligned as shown or offset, are normally closed to block flow through the passages 284 although it will be seen they may be open. The number of gate valves can vary from one to many. With one gate valve, it will intersect every passage 284. If the channel cover 272 were partitioned, as many gate valves could be used as there are partitions.

When it is desired to conduct a maintenance operation on a selected one of the tubes 274, the valves 286, 288 can be closed and the closure 312 aligned with one end of the selected tube 274 is removed. An isolation tool 314 is inserted into the open passage 284 until the seals 310 seat around the outside of the tool 314 and the associated valve 286, 288 opened. This allows the tool 314 to be passed through the passage 284 along the axis 316 into sealing engagement with the selected tube 274. The same operation is conducted on the other end of the tube 274, i.e. another isolation tool 314 is run into the heat exchanger 270 on the other side of the partition 276 to seat against the opposite end of the selected tube 274 thereby isolating the selected tube 274 from tube side flow. A cleaning implement, wall thickness measuring device or other maintenance tool is run through the isolation tools 314 to perform the desired maintenance. The isolation tools 314 are then removed from the heat exchanger 270 in reverse order to place the selected tube back into service. This is repeated with successive ones of the tubes 274 until a desired number of the tubes 274 are cleaned and/or inspected.

Figure 23:
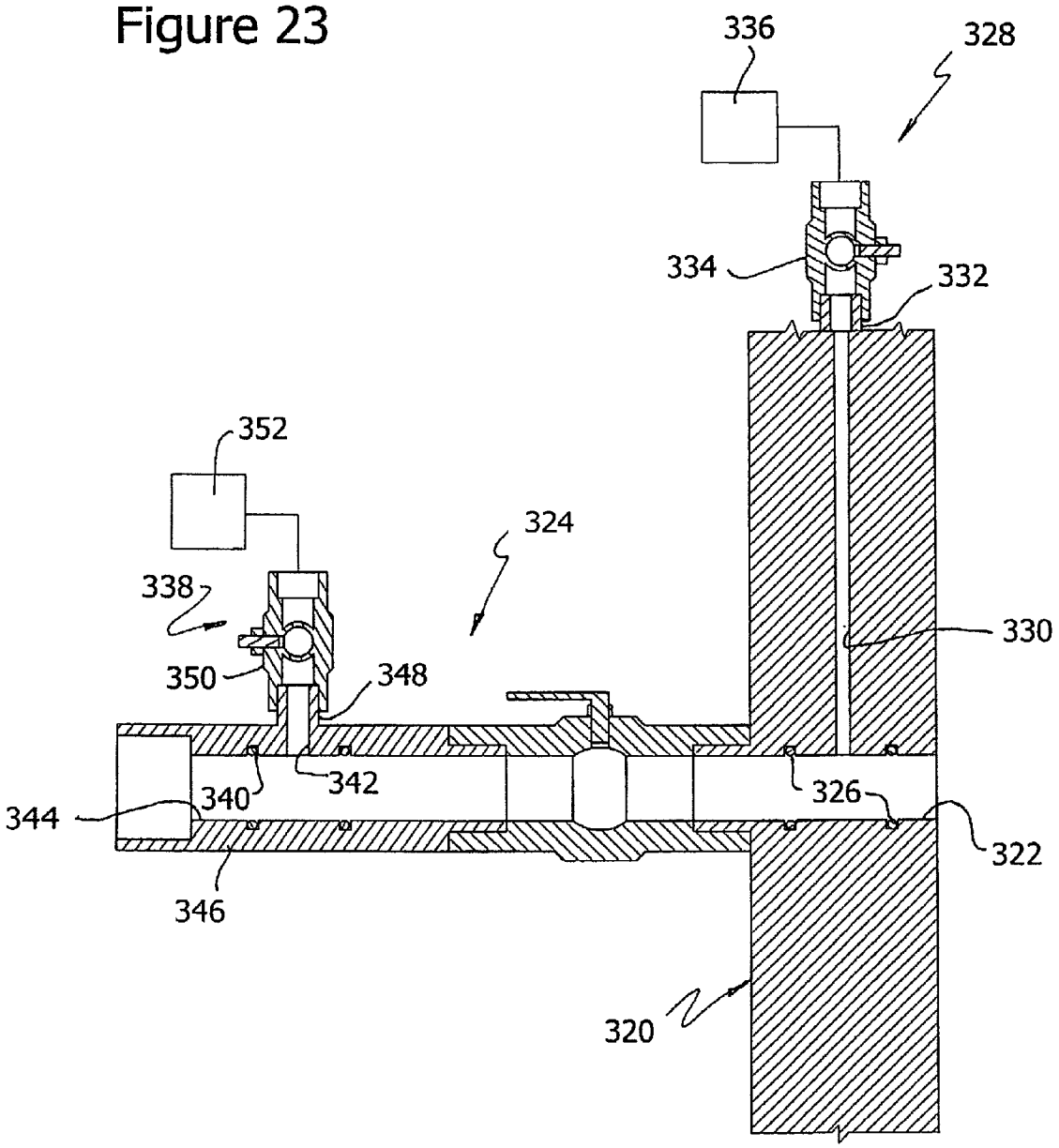
FIG. 23 is a cross-sectional view of a channel cover and valve-seal assembly showing a safety feature.

Referring to FIG. 23, a safety device for a heat exchanger is illustrated where a channel cover 320 provides an opening 322 closed by a valve-seal assembly 324 similar to that shown in FIGS. 1-2. One or more seals 326 can be provided to close about the exterior of an isolation tool (not shown) and normally prevent tube side flow from escaping. If it were desired to provide a safety back up for seals 326 in the passage 322, a safety system 328 is provided. The safety system 328 includes a passage 330 through the channel cover 320 opening at one end into the passage 322 between the seals 326 and opening at the other end through the exterior of the channel cover 320. A fitting 332 connects to the channel cover 320 and provides a valve 334 controlling flow into and out of the passage 330. A source 336 of pressurized gas or liquid can connect to the valve 334 and is at a higher pressure than inside the tube side channel. In the event the seals 326 were to begin leaking, a suitable gas or can be injected between the seals 326 at a higher pressure than in the heat exchanger thereby cutting off the flow of tube side fluid. The gas can be nitrogen in the event tube side flow is flammable or air if tube side flow is water and combustion is not a problem.

A similar safety system 338 can be provided for the valve-seal assembly 324 to provide a back up for seals 340 which normally prevent tube side flow from escaping around the outside of one of the isolation tools. The safety system 338 can include a passage 342 opening into the central passage 344 of a guide block 346 between the seals 340. The safety system 338 can provide a fitting 348 on the guide block 346 and a valve 350 to control flow into and out of the passage 342. A source 352 of pressurized gas or liquid can connect to the valve 350 and is at a higher pressure than inside the tube side channel. In the event the seals 340 were to begin leaking, a suitable gas or liquid can be injected between the seals 340 at a higher pressure than in the heat exchanger thereby cutting off the flow of tube side fluid. The gas can be nitrogen in the event tube side flow is flammable or air if tube side flow is water and combustion is not a problem.

Figure 24:
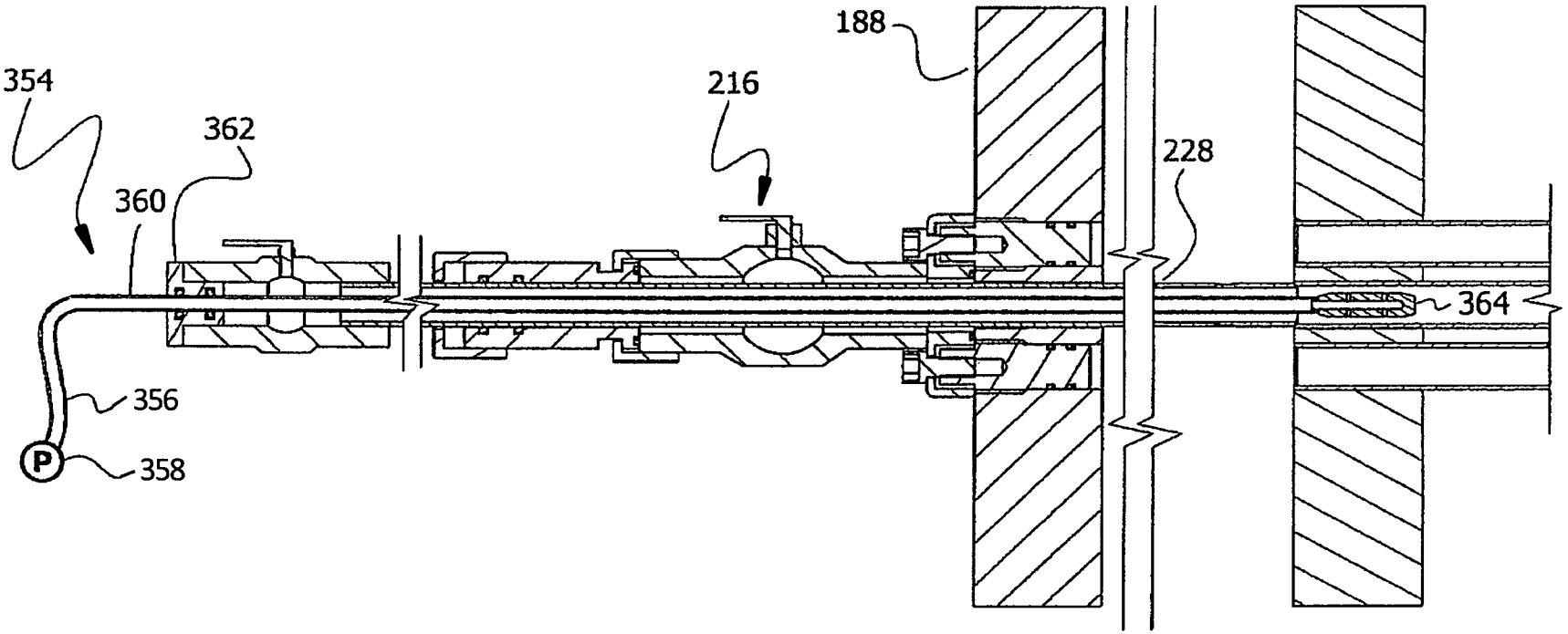
FIG. 24 is a pictorial view of a pressure washing system; describe FIGS. 23 and 24

FIG. 24 illustrates a high pressure liquid cleaning system 354 used to clean one of the heat exchanger tubes using the equipment of FIG. 1, 2, 7, 17, 21 or 22 where a pair of isolation tools 228 isolate one of the tubes. The cleaning system 354 comprises a hose 356 connected between a source of high pressure liquid 358 and to a tube or lance 360 of sufficient length to pass a desired distance into the selected heat exchanger tube. An insert 362 threaded into the end of a valve on the isolation tube 228 provides seals engaging the exterior of the lance 360 to prevent the back wash of cleaning liquid and any shell side fluid that may be leaking through a hole developed during cleaning. Thus, wash water or other cleaning liquid exits through the other isolation tool through a hose and may be disposed of in any suitable manner. The lance 360 is inserted through one of the isolation tools 228 in the manner shown in FIG. 17. Wash water delivered through a nozzle 364 cleans the interior of the selected tube and flows out through the other isolation tube.

Figure 25:
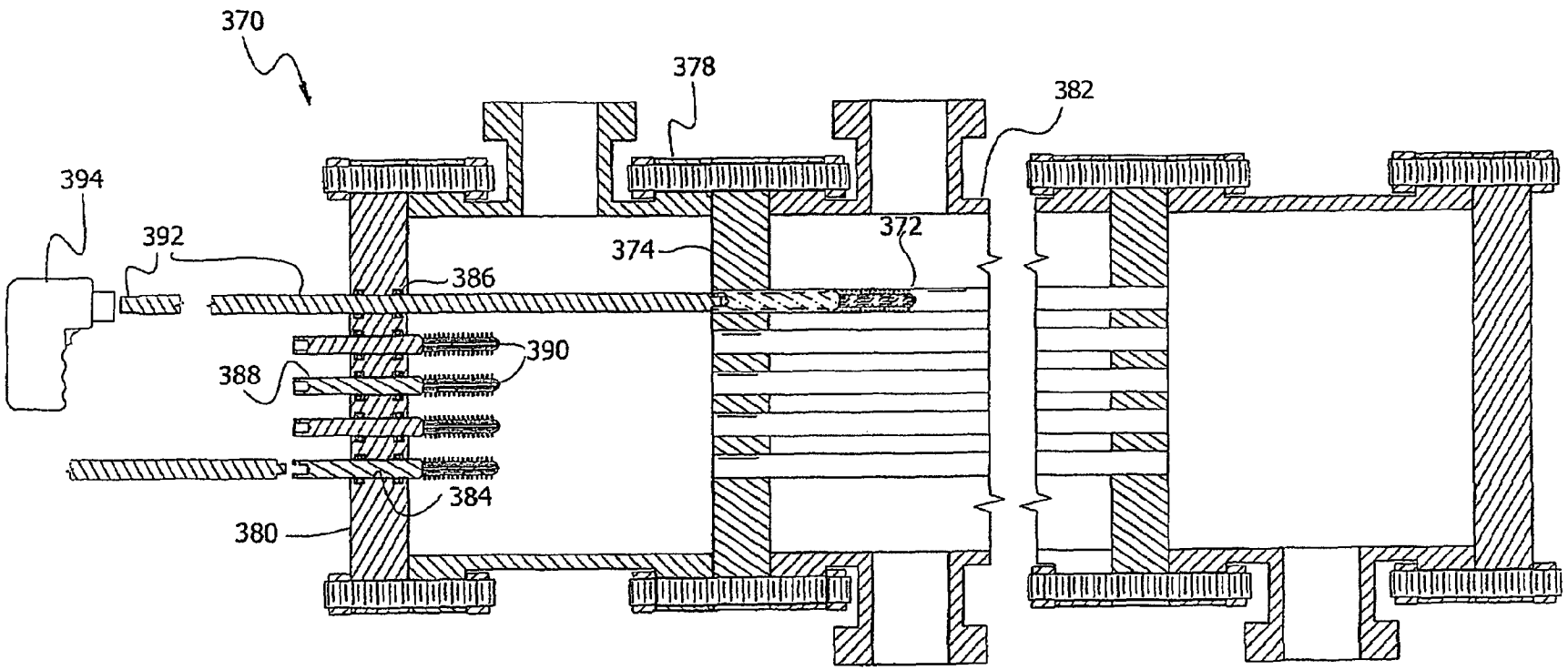
FIG. 25 is a cross-sectional view of another heat exchanger illustrating another approach to on-line cleaning.

Referring to FIG. 25, there is illustrated another approach for maintaining an on-line heat exchanger that is simpler and which is based on the proposition that the purpose of on-line maintenance is to keep the heat exchanger operating at full capacity until the next scheduled outage or turnaround and that the bulk of heat exchanger problems can be alleviated by cleaning the tubes. In other words, if the tubes can be mechanically cleaned, most maintenance operations can usually be deferred until the plant is shut down.

The heat exchanger 370 is illustrated as of the straight through type having tubes 372 opening through a tube sheet 374 into a compartment 376 provided by a channel 378 closed by a channel cover 380. A shell 382 can provide for shell side flow. The channel cover 380 includes a series of a passages 384 aligned with the tubes 372 and having one or more seal assemblies 386 therein sealing against the exterior of a rod or shaft 388 which is conveniently round. A brush 390, scraper or other suitable cleaning device can be attached to the end of the rod 388. During normal operation of the heat exchanger 380, the brushes 390 are retracted toward the channel cover 380 as shown in the center of FIG. 25 out of the normal flow path through the compartment 376.

When it is desired to clean the tubes 372, one or more extensions 392 can be attached to the rod 388 to advance the brush 390 into the aligned tube 372 as shown in the bottom of FIG. 25. The brush 390 may be rotated by a suitable mechanism 394 such as an air or electrically powered motor. The brushes 390 are independently run into the tubes 372 so one or a few tubes 372 are cleaned at one time. Normally, only one brush 390 is advanced at a time into one of the tubes 372, then withdrawn and the process repeated with as many, or all, of the brushes 390 to restore the heat exchanger 370 to a desired capacity. There are many advantages to advancing the brushes 390 independently, the most important of which is that, when ganged together, there is too much risk that one of the brushes can be prevented from passing through its assigned tube whereupon the entire assembly cannot be moved or the assembly becomes canted and cannot be advanced. The brushes 390 are of somewhat unusual design and will be more fully described in connection with FIG. 29.

Figure 26:
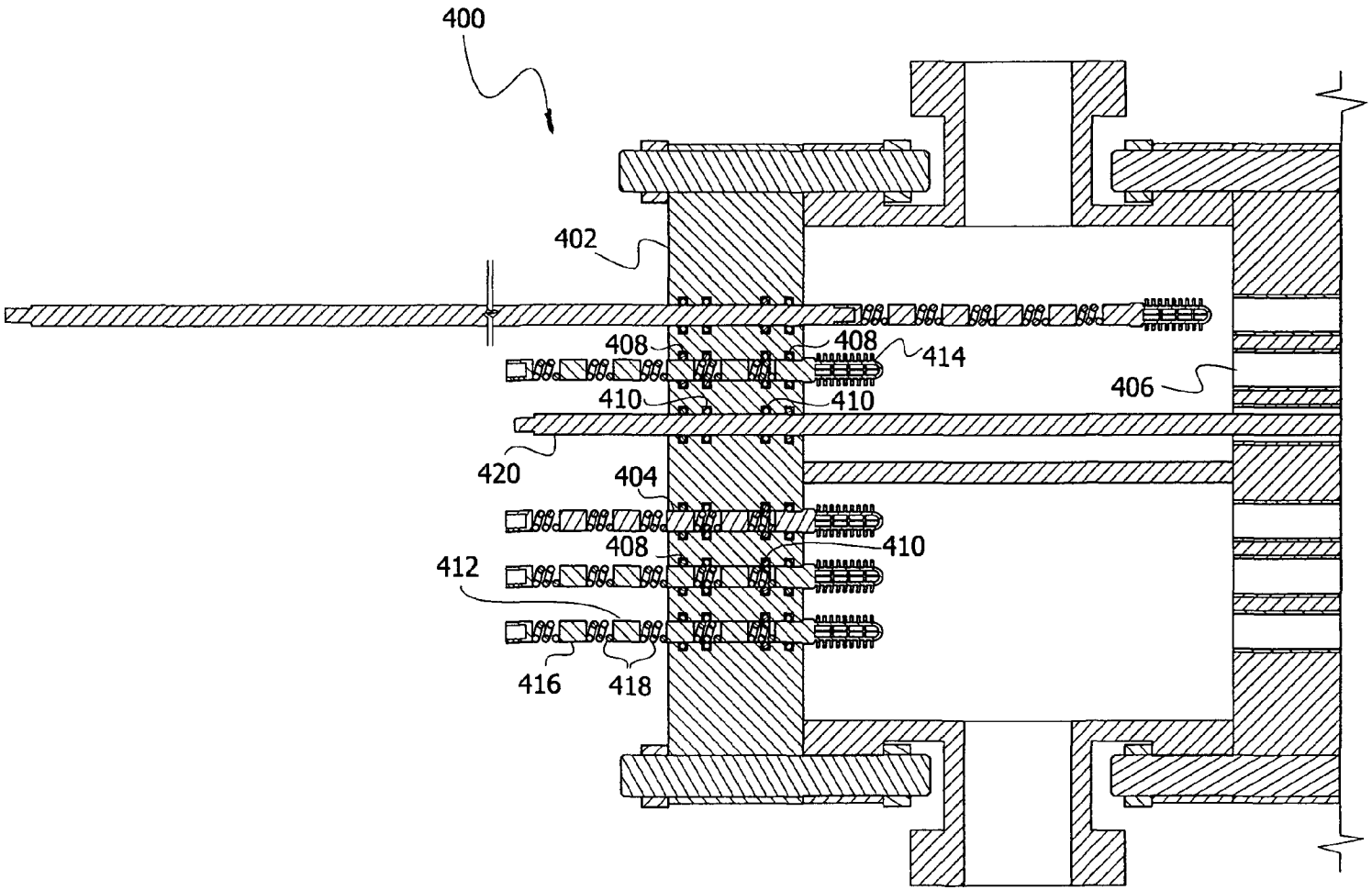
FIG. 26 is a cross-sectional view of another heat exchanger illustrating an approach similar to that of FIG. 25.

Referring to FIG. 26, there is illustrated an approach similar to FIG. 25 that can be used for U-tube type heat exchangers 400. The problem with cleaning U-tube type heat exchangers is the cleaning implement should reach at least half way through the bend in the tube. As shown in FIG. 26, a channel cover 402 includes passages 404 which can align with tubes 406. Two sets of seals 408, 410 in the passages 404 seal about the exterior of a rod or shaft 412 which can be circular having a brush 414 or other cleaning implement on its end. The rod 412 can includes smooth rigid sections 416 alternating with bendable resilient sections 418 which can be short helical springs. Thus, the spacing between the seal sets 408, 410 and the lengths of the rigid and resilient sections 416, 418 are such that the periphery of the rod 412 is sealed in any position of the rod 412. In other words, as the rod 412 is pushed through the passage 404, one set 408 or the other set 410 will engage one of the smooth sections 416 and thereby prevent leakage of tube side flow through the passage 404.

It will be seen that any of the tubes 406 can be cleaned by adding extensions 420 to the shaft 412 of the aligned brush 414 and advancing the brush 414 into the tube 406. As the brush 414 enters the U part of the tube 406, the shaft 412 curves to fit the inside of the U. The length of the flexible part of the shaft 412 can be at least half the length of the U so cleaning the inlet and outlet tubes effectively cleans the entire U-tube. Thus, the rod or shaft 412 is sufficiently flexible to pass at least half way through the U of the tubes 406.

Figure 27:
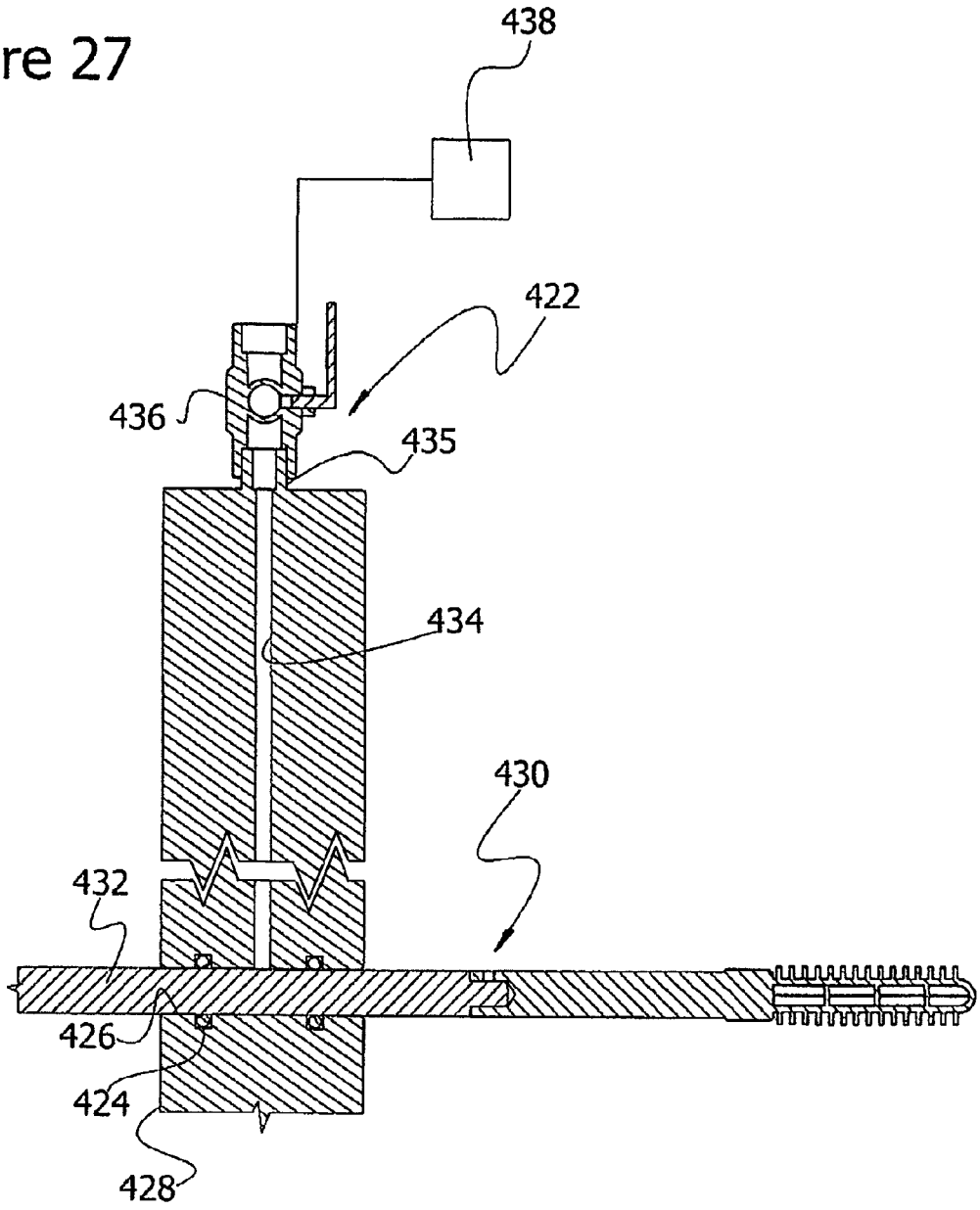
FIG. 27 is a cross-sectional view of a heat exchanger illustrating another technique for maintaining a heat exchanger.

Referring to FIG. 27, there is illustrated a safety system 422, similar to FIG. 23, providing a back up for seals 424 in a passage 426 of a channel cover 428. As in the embodiments of FIGS. 25 and 26, a brush assembly 430 can extend through the channel cover 428 during normal operation of the heat exchanger and be advanced into cleaning engagement with a heat exchanger tube. The exterior of a shaft 432 is normally sealed by the seals 424. In the event the seals 424 begin to leak, the safety system 422 is actuated. The safety system 422 includes a passage 434 opening into the passage 426 between the seals 424 and opening through a fitting 435 on an exterior of the channel cover 428. A valve 437 connects to a source 438 of gas, such as nitrogen, or liquid at a pressure higher than inside the heat exchanger. Opening the valve 436 delivers the fluid between the seals 424 and prevents tube side flow from exiting around the handle 432.

Figure 28:
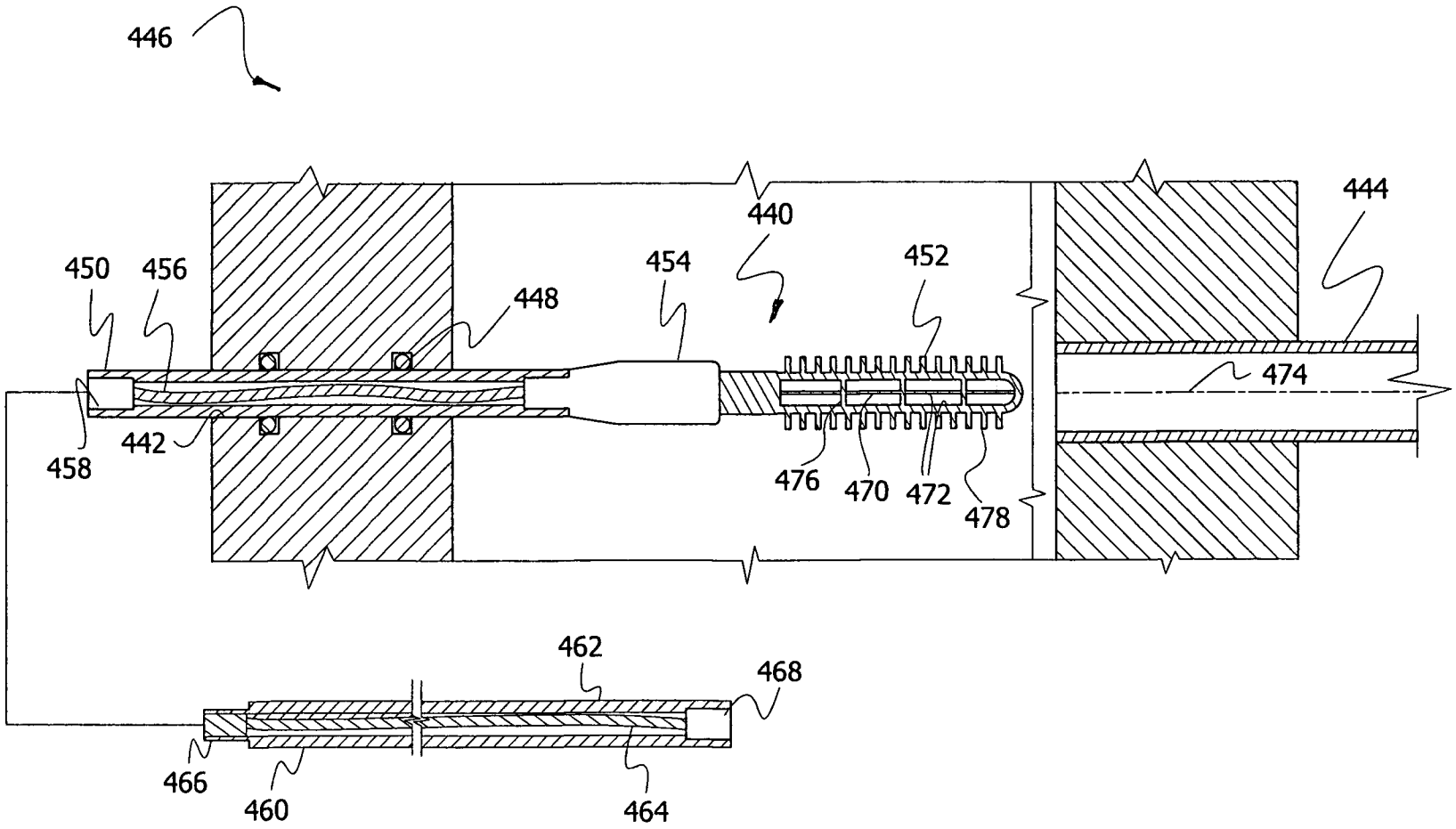
FIG. 28 is a cross-sectional view of a heat exchanger illustrating another technique for maintaining a heat exchanger.

Referring to FIG. 28, there is illustrated a variation of FIG. 25 or 26 where a series of cleaning assemblies 440 are mounted in a series of passages 442 coaxial with a series of tubes 444 of a heat exchanger 446. Seals 448 in the passages 442 seal on a round hollow handle 450 of the cleaning assembly 440. The cleaning assemblies 440 include a set of bristles or other cleaning elements 452 and a wall thickness measurement sensor 454. The sensor 454 may be of any suitable type such as an eddy current coil or other suitable wall thickness measuring device. A communication link such as a wire 456 extends through the hollow handle 450 and terminates in an electrical connector 458. One or more extensions 460 can be provided to push the cleaning elements 452 and sensors 454 into and/or through the tube 444. The extensions 460 can include a hollow handle 462, a communication link or wire 464 having a terminal 466 at one end to engage the connector 458 and a terminal 468 at the other end for connection to another extension (not shown). Providing the thickness measurement sensor 454 on the inside of the heat exchanger 446 along with the cleaning element 452 allows both cleaning and inspecting to be done with the arrangements of FIG. 25 or 26.

FIG. 28 also illustrates in greater detail what may be a preferred design of the cleaning element or brush 452. Because the cleaning assembly 452 does not substantially obstruct the tube 444, tube side flow through the assembly 452 while it is being moved through the tube 444 allows debris removed from the tube to be carried away in the tube side flow. To this end, the brush 452 can preferably include a porous frame 470 having several longitudinally extending frame members 472 extending radially around a brush axis 474 and a series of transverse frame members 476 secured to the longitudinal frame members 472. A series of bristles 478 are secured to the frame members 472, 476 and are of a material compatible with tube side flow at operating temperatures. Thus, when water is the tube side flow at modest temperatures, the frame members and bristles may be made of plastic, stainless steel or other suitable material but when tube side flow is hot process fluid, more sophisticated alloys can be preferred.

Figure 29:
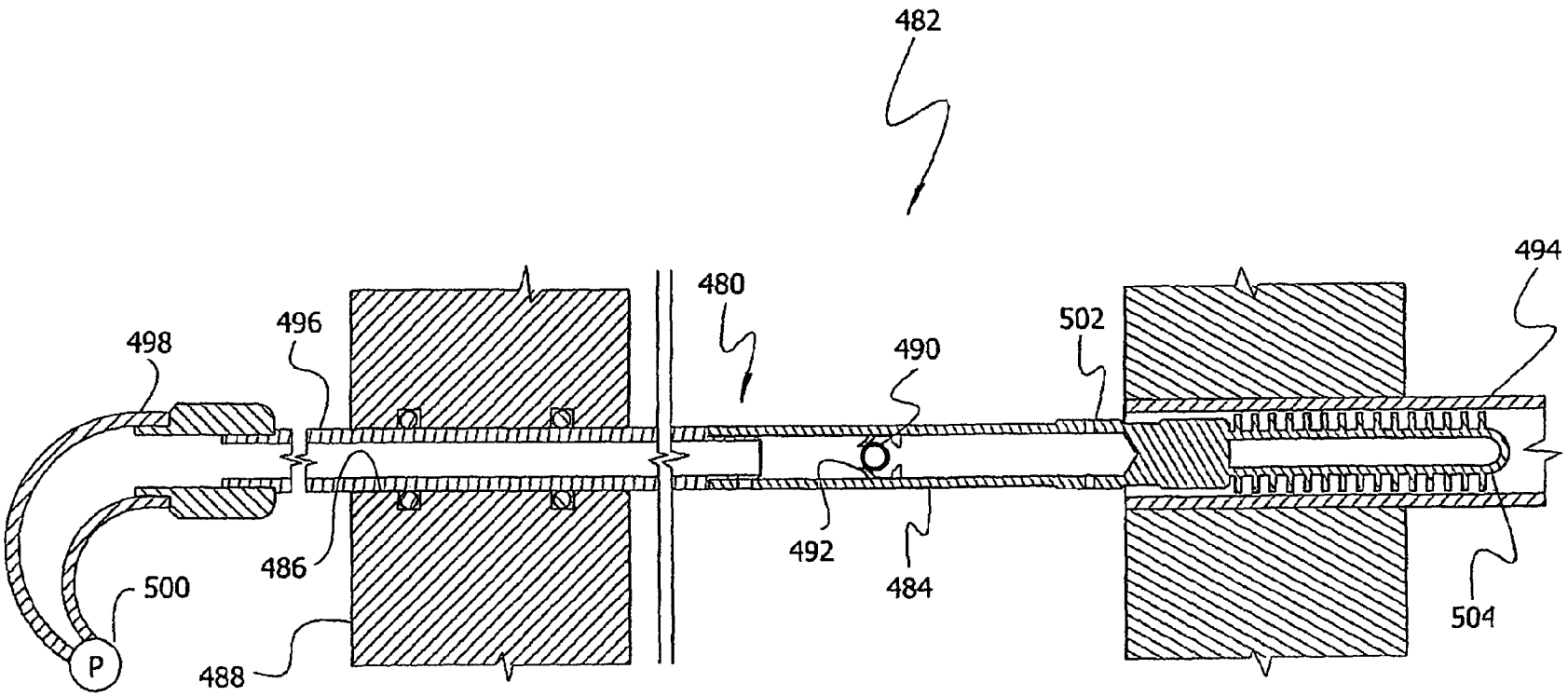
FIG. 29 is a cross-sectional view of a heat exchanger illustrating another technique for maintaining a heat exchanger.

Referring to FIG. 29, there is illustrated a pressure wash system similar to FIG. 24 that can be used in the embodiments of FIG. 25 or 26. As in the embodiments of FIGS. 25 and 26, a cleaning assembly 480 can remain inside a heat exchanger 482 during normal use, meaning that a hollow lance 484 extends through a sealed passage 486 in the channel cover 488. To prevent back flow of tube side flow through the handle 484, a check valve comprising a ball check 490 and a valve seat 492 can be provided. Suitable means may be provided to prevent the ball check 490 from travelling to the right in FIG. 29, such as shoulders extending into the passage of the hollow lance 484. When it is desired to pressure wash one of the tubes 494, one or more hollow extensions 496 can be attached to the handle 484 and then connected by a hose 498 or other suitable device to a source 500 of high pressure cleaner, which is usually water, a mixture of water and cleaning chemicals, a mixture of water and particulate solids or a suspension of particulate solids in a gas such as air or nitrogen. It will be seen the ball check 490 and seat 492 prevent tube side flow from backing up through the handle 484 and/or extension 496. Activating the pump 500 delivers high pressure cleaning liquid through a nozzle or nozzles 502 to remove deposits from inside the tube. When the cleaning operation is over, the hose 500 is detached from the outermost extension 496, the extensions 496 are retracted to the left in FIG. 29 to position the nozzle 502 and the brush assembly 504 adjacent the channel cover 488 which is substantially out of the flow path through the channel cover 488.

Figure 30:
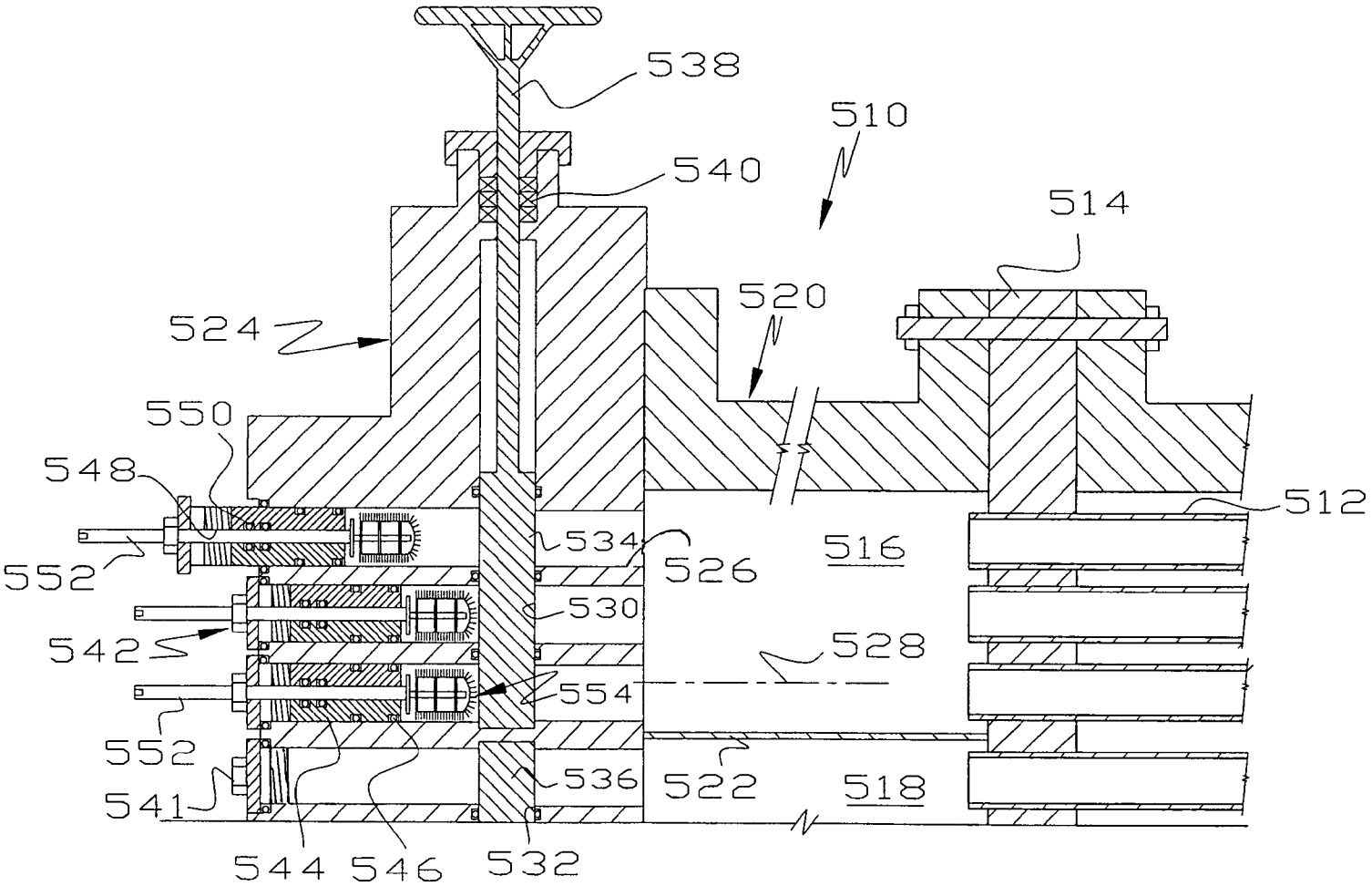
FIG. 30 is a cross-sectional view of a heat exchanger illustrating another technique for maintaining a heat exchanger.

Referring to FIG. 30, there is illustrated another technique for maintaining a heat exchanger 510 comprising a dense array of tubes 512 opening through a tube sheet 514 into a pair of compartments 516, 518 provided by a channel 520 and separated by a partition wall 522. The embodiment of FIG. 30 is illustrated as a modification of the embodiment of FIG. 22 so a channel cover 524 can be of the type providing a series of passages 526 coaxial with the tubes 512 as suggested by the axis 528. The passages 526 are intersected by one or more valve body passages 530, 532 through which a valve body 534, 536 may move as controlled by a handle 538 extending through a packing 540. Normally, a simple plug 541 having an O-ring or gasket closes each of the passages 526 and the passages 526 are empty. When it is desired to start a maintenance operation on the heat exchanger 510, the simple plugs 541 are removed and replaced by a series of plugs 542.

The channel cover 524 is of a sufficient depth that there is sufficient room for a series of plugs 542 to be threaded into the open end of the passages 526. The plugs 542 can each include a body 544 having external seals 546 for sealing against the passage 526 and a central passage 548 having interior seals 550 for sealing about the periphery of a brush handle 552 comprising part of a brush assembly 554. With the plugs 542 in place, cleaning of the tubes 512 can commence by retracting the appropriate gate valve body 534, 536 to expose one or more of the brush assemblies 554. As in previous embodiments, extensions (not shown) can be attached to the handles 552 so the brush assemblies 554 can be pushed into and/or through the tubes 512 and rotated if desired. When cleaning is finished, the brush assemblies 554 are retracted to the left and the valve body 534 closed so the plugs 542 can be removed and the passages 526 sealed by simple plugs 541. One advantage of this is that cleaning can be quickly accomplished by loading a desired number of passages 526 with the plugs 542 and brush assemblies 554, cleaning the tubes 512 associated with the loaded passages 526. In the alternative, the plugs 542 can remain in the heat exchanger 510 and the brush assemblies 554 are isolated from tube side flow and are not subject to corrosion. In addition, the plugs 542 can be removed and replaced if the brush assemblies 554 become ineffective.

Although FIGS. 9-14, 23, 24 and 27-29 are illustrated as involving only one heat exchanger tube, it will be understood that all, or substantially all, of the tubes of the heat exchanger can be equipped or treated in the manner shown with one tube.

It is apparent that different strategies may be followed in use of the disclosed method and apparatus. One strategy is to use the disclosed method and apparatus to improve the efficiency of heat exchangers when they exhibit reduced capacity. This is a minimalist approach. Another strategy is to use the disclosed method and apparatus to clean and inspect heat exchangers on a regular schedule so, during the next turnaround, no maintenance has to be done on heat exchangers unless it is to replace plugged tubes. This approach has a subtle cost advantage because regular maintenance is much less expensive than maintenance during turnarounds. Other apparent strategies use the disclosed method and apparatus in some intermediate manner.

In the case of a floating head heat exchanger, there is no tube that extends directly from the inlet compartment to the outlet compartment. In such a situation, only one isolation tool need be inserted through a channel cover to provide a path of movement for a cleaning element or an inspection tool. Any debris removed from the tube wall necessarily flows to the outlet and may be separated from tube side flow in any suitable manner. In fact, cleaning of any heat exchanger can be done by inserting only one isolation tool and cleaning only the tube it seats against.

Referring to FIG. 1, another advantage of the disclosed method and apparatus is illustrated where a restraining device 556 can connect to one of the flange bolts 30 and have an abutment 558 adjacent to the end of the isolation tool 90. The restraining device 556 can include an adjustable length mechanism 560 so the abutment 558 can be forcibly advanced toward the channel cover 28 to force the isolation tool 90 into the compartment 36 to overcome the force of fluid pressure acting on the tool 90.

If the improvements disclosed herein are incorporated into a heat exchanger at the time of manufacture, alignment of passages in the channel covers with the heat exchanger tubes is accomplished at this time. If the improvements disclosed herein are retrofitted onto existing heat exchangers during a turnaround, it is possible that the modified channel covers can be manufactured based on drawings of the tube sheet and tube array of the heat exchanger to be retrofitted. If existing heat exchangers have too much variation in the placement of tubes in the tube sheet, the existing channel covers are removed and measurements taken of the location of the ends of the heat exchanger tubes so passages can be machined in the channel covers in alignment with the heat exchanger tubes. During a turnaround, machining or modification of the tube sheet or tubes can be done to provide the junction shown in FIGS. 10-15 and 20.

Although this invention has been disclosed and described in its preferred forms with a certain degree of particularity, it is understood that the present disclosure of the preferred forms is only by way of example and that numerous changes in the details of operation may be resorted to without departing from the spirit and scope of the invention as hereinafter claimed.

We claim:

1. A combination comprising a heat exchanger comprising a pair of compartments, an array of closely spaced tubes having an inlet end opening into a first of the compartments and an outlet end opening into a second of the compartments, a channel cover closing an end of at least one of the compartments and providing passages directed at ends of the tubes, the tubes providing a first path of fluid movement therethrough, a second path of fluid movement being on an exterior of the tubes, at least a plurality of assemblies on the channel cover adapted to insert maintenance elements through the channel cover passages into the heat exchanger under pressure and minimizing leakage from the heat exchanger, and a maintenance element extending through at least one of the assemblies for conducting maintenance on one of the tubes, the assemblies including a seal adapted to seal on the outside of the maintenance elements and a valve, having a valve passage therethrough, between the seal and the channel cover, the valve comprising a valve seat and a valve member, the valve member being movable between a first position allowing movement of the maintenance element through the valve passage and a second position closing the valve passage after removal of the maintenance element, the maintenance element being movable axially through the seal toward and away from the tubes and being moveable through the valve passage in one direction and out of the valve in an opposite direction whereby the maintenance element may be removed from the heat exchanger compartment while the heat exchanger is under pressure, the assemblies being positioned and being adapted so maintenance elements can be inserted through the assemblies into at least 80% of the tube ends.

2. The heat exchanger of claim 1 wherein the tubes include an outside diameter and the tubes have the same outside diameter and there is a clearance between adjacent tubes, the ratio of clearance to outside diameter being in the range of 0.2-0.5.

3. The heat exchanger of claim 1 wherein the tubes include an inner diameter and the tubes have the same inner diameter and the maintenance element comprises a conduit having an inner diameter, the inner diameter of the conduit being at least as large as the inner diameter of the tubes.

4. The heat exchanger of claim 1 wherein the channel cover passages are generally parallel to the tubes and the channel cover provides a passage perpendicularly intersecting a multiplicity of the channel cover parallel passages and a valve member in the intersecting valve passage isolating a first end of the channel cover parallel passages from a second end thereof and wherein the valve member is a rotary valve member.

5. The heat exchanger of claim 1 wherein the channel cover passages are generally parallel to the tubes and the channel cover provides a passage perpendicularly intersecting a multiplicity of the channel cover parallel passages and a valve member in the intersecting valve passage isolating a first end of the channel cover parallel passages from a second end thereof and wherein the valve member is a reciprocable valve member.

6. The heat exchanger of claim 1 wherein a first end of the channel cover passages opens into the first compartment and a second end of the channel cover passages opens into an exterior of the channel cover, there being a plug in the second channel cover passage end, the plug having an opening therethrough, there being a cleaning assembly in the second passage end having a handle extending through the plug opening and seals between the handle and the second passage end.

7. A heat exchanger comprising a pair of compartments, an array of closely spaced tubes having an inlet end opening into a first of the compartments and an outlet end opening into a second of the compartments, the tubes providing a first path of fluid movement, a second path of fluid movement being on an exterior of the tubes, the ratio of clearance between adjacent tubes to the outer diameter of the tubes being in the range of 0.2-0.5, and at least a plurality of assemblies on the compartments adapted to insert isolation conduits having a predetermined inner diameter into the heat exchanger under pressure and minimizing leakage from the heat exchanger, an isolation conduit extending through one of the assemblies into sealing engagement with a selected one of the tubes, the inner diameter of the isolation conduit being at least 75% of the inner diameter of the tube, at least some of the assemblies including a seal sealably engaging an exterior of the isolation conduit and allowing axial movement of the isolation conduit toward and away from the tube ends and a valve, having a valve passage therethrough, between the seal and the channel cover, the valve comprising a valve seat and a valve member, the valve member being movable between a first position allowing movement of an isolation conduit through the valve passage and a second position closing the valve passage after removal of the isolation conduit, the assemblies being positioned and being adapted so isolation conduits can be inserted through the assemblies into at least 80% of the tube ends.

8. The heat exchanger of claim 7 further comprising a tube sheet through which the tubes open, a junction between the tube sheet and the tube having a bevel to receive and guide the isolation conduit into coaxial relation with the tube.

9. The heat exchanger of claim 7 wherein at least some of the tube ends having a funnel thereon, the funnel being in one of the compartments.

10. The heat exchanger of claim 9 wherein the funnel comprises part of the tube end.

11. The heat exchanger of claim 7 further comprising a tube sheet through which the tubes open and wherein at least some of the tube ends comprise a straight section in one of the compartments for sealably receiving an isolation conduit having seals thereon.

12. The heat exchanger of claim 11 wherein the straight section comprises part of the tube sheet.

13. The heat exchanger of claim 11 wherein the straight section comprises part of the tube end.

14. The heat exchanger of claim 7 wherein the isolation conduit is a first isolation conduit sealed to the inlet end of a predetermined tube and the first path of fluid movement includes the compartments into which the tubes open and further comprising a second isolation conduit sealed to the outlet end of the predetermined tube, the first and second isolation conduits comprising part of a fluid circuit separate from the first and second paths of fluid movement and a fluid supply system delivering a maintenance fluid through the fluid circuit.

15. A heat exchanger comprising a pair of compartments, an array of closely spaced tubes having an inlet end opening into a first of the compartments and an outlet end opening into a second of the compartments, a channel cover closing an end of at least one of the compartments and providing passages directed at ends of the tubes, the tubes providing a first path of fluid movement therethrough, a second path of fluid movement being on an exterior of the tubes, at least a plurality of assemblies on the channel cover adapted to insert maintenance elements through the channel cover passages into the heat exchanger under pressure and minimizing leakage from the heat exchanger, the assemblies including a seal adapted to seal on the outside of maintenance elements inserted through the assembly, and a valve, having a valve passage therethrough, between the seal and the channel cover, the valve comprising a valve seat and a valve member, the valve member being movable between a first open position allowing maintenance elements to be inserted into one of the heat exchanger compartments through the valve passage and a second position closing the valve passage after maintenance elements are removed from the heat exchanger compartment whereby a maintenance element may be moved axially through the seal and through the valve passage toward and away from the tubes to accomplish a cleaning function and then removed through the valve passage whereby the maintenance element may be removed from the heat exchanger compartment, the assemblies being positioned and being adapted so maintenance elements can be inserted through the assemblies into at least 80% of the tube ends.

* * * * *